US009534429B2

(12) United States Patent
Spurr et al.

(10) Patent No.: US 9,534,429 B2
(45) Date of Patent: Jan. 3, 2017

(54) LATCH APPARATUS

(71) Applicant: PYEONGHWA AUTOMOTIVE CO., LTD., Dalseo-Gu Daegu (KR)

(72) Inventors: Nigel Spurr, Staffordshire (GB); Gurbinder Singh Kalsi, Staffordshire (GB); Sang Beom Hur, Dalseo-Gu Daegu (KR); Ki Ryun Ahn, Dalseo-Gu Daegu (KR); Jong Chul Oh, Dalseo-Gu Daegu (KR)

(73) Assignee: PYEONGHWA AUTOMOTIVE CO., LTD. (KR)

( * ) Notice: Subject to any disclaimer, the term of this patent is extended or adjusted under 35 U.S.C. 154(b) by 153 days.

(21) Appl. No.: 14/152,399

(22) Filed: Jan. 10, 2014

(65) Prior Publication Data

US 2015/0097379 A1 Apr. 9, 2015

(30) Foreign Application Priority Data

Oct. 8, 2013 (KR) ..... 10-2013-0120178

(51) Int. Cl.
*E05C 3/06* (2006.01)
*E05B 85/26* (2014.01)
*E05B 15/00* (2006.01)

(52) U.S. Cl.
CPC ..... *E05B 85/26* (2013.01); *E05B 15/0086* (2013.01); *Y10T 292/108* (2015.04)

(58) Field of Classification Search
CPC ..... E05B 85/20; E05B 85/26; E05B 85/24; E05B 85/243; E05B 15/0086; E05B 79/10
USPC ..... 292/201, 216, 198, 200, DIG. 23
See application file for complete search history.

(56) References Cited

U.S. PATENT DOCUMENTS 4,756,563 A * 7/1988 Garwood ..... E05B 85/243 292/216
5,054,827 A * 10/1991 Konchan ..... E05B 85/243 292/216
5,188,406 A * 2/1993 Sterzenbach ..... E05B 85/26 292/210
5,277,461 A * 1/1994 Dzurko ..... E05B 85/243 292/216

(Continued)

FOREIGN PATENT DOCUMENTS

DE 102012203734 A1 * 9/2013 ..... E05B 85/26

OTHER PUBLICATIONS

Chinese Office Action dated Apr. 6, 2016; Application No. 201310750842.4; Pyeonghwa Automotive Co., Ltd.; 12 pgs.

*Primary Examiner* — Alyson M Merlino
(74) *Attorney, Agent, or Firm* — Schmeiser, Olsen & Watts, LLP

(57) ABSTRACT

Disclosed herein is a latch apparatus. The latch apparatus includes: a base formed with an opening; a latch gear formed with a mounting groove to lock a striker entering the mounting groove through the opening; a pawl rotatably disposed on the base and engaging with the latch gear to prevent rotation of the latch gear; a release lever disposed to adjoin the pawl, transmitting constraint force of pressing the pawl, and rotating the pawl to release the latch gear; a support shaft secured to the base, supporting a lateral surface of the pawl and transmitting the constraint force of pressing the pawl; and a guide portion rotatably provided to the support shaft, pressed to rotate by the release lever, and guiding movement of a projection pin provided to the pawl.

5 Claims, 30 Drawing Sheets

(56) References Cited

U.S. PATENT DOCUMENTS

| | | | | | |
|---|---|---|---|---|---|
| 5,454,608 | A * | 10/1995 | Dzurko | E05B 81/90 | 292/216 |
| 5,921,595 | A * | 7/1999 | Brackmann | E05B 83/36 | 292/201 |
| 5,961,163 | A * | 10/1999 | Brackmann | E05B 81/06 | 292/201 |
| 6,305,727 | B1 * | 10/2001 | Bland | E05B 85/243 | 292/216 |
| 2007/0205613 | A1 * | 9/2007 | Berghahn | E05B 81/20 | 292/216 |
| 2012/0313384 | A1 | 12/2012 | Cumbo et al. | | |
| 2015/0167363 | A1 | 6/2015 | Scholz et al. | | |
| 2015/0259954 | A1 | 9/2015 | Spurr et al. | | |

* cited by examiner

LATCH APPARATUS

BACKGROUND

1. Technical Field

The present invention relates to a latch apparatus, and more particularly, to a latch apparatus which allows a latch gear to be easily opened even by small force.

2. Description of the Related Art

Generally, in a latch apparatus for vehicles, a latch gear having a mounting groove and a pawl for restricting a locking end of the latch gear are rotatably disposed on a base plate having an opening.

The pawl receives rotational force from a handle and releases the latch gear from restriction, thereby allowing a door to be opened.

The latch gear includes a first locking portion and a second locking portion, thereby forming a two-stage locking condition in which the latch gear locking a striker is locked by the pawl.

When the striker enters the mounting groove of the latch gear, the latch gear rotates in one direction and the pawl is locked to the first locking portion of the latch gear, thereby forming a first locking stage.

When the latch gear is pushed by the striker and thus completely rotated, the pawl is locked to the second locking portion of the latch gear, thereby forming a second locking stage.

To move the latch gear from a locking location of the second locked state to a release location, releasing force is transmitted to the pawl such that the pawl can be separated from the latch gear.

If the pawl receiving manipulation force from the handle is separated from the latch gear, the latch gear is rotated in a releasing direction when opening force is applied to the door, thereby separating the striker from the latch gear.

A door seal is disposed along an edge of the door of the vehicle to block water and dust from entering the door.

The door seal is made of rubber and has elasticity. Thus, when the door is closed, the door seal applies force to the door in an opening direction.

In addition, the striker applies torque to the latch gear in a direction of releasing from the latch apparatus. The torque applied to the latch gear generates resistance to engagement between the latch gear and the pawl, thereby increasing a constraint force of the latch apparatus locking the striker increases.

A background technique of the present invention is disclosed in Korean Patent Publication No. 1998-0018831 (published on Jun. 5, 1998 and entitled "LATCH APPARATUS FOR VEHICLE REAR DOOR").

When the door seal is compressed as the vehicle door is closed, the door is urged in an opening direction by restoring force of the door seal, thereby increasing torque transmitted to the latch gear. To release the pawl from the latch having the increased torque, a force for operating the pawl must also be increased, thereby making it difficult for old persons or the like to operate the handle and open the door. There, there is a need for a latch apparatus overcoming such a problem.

BRIEF SUMMARY

The present invention has been conceived to solve the foregoing problem in the art, and an aspect of the present invention is to provide a latch apparatus which allows a latch gear to be easily opened even by small force.

In accordance with one aspect of the invention, a latch apparatus includes: a base formed with an opening; a latch gear formed with a mounting groove to lock a striker entering the mounting groove through the opening; a pawl rotatably disposed on the base and engaging with the latch gear to prevent rotation of the latch gear; a release lever disposed to adjoin the pawl, transmitting constraint force of pressing the pawl, and rotating the pawl to release the latch gear; a support shaft secured to the base, supporting a lateral surface of the pawl and transmitting the constraint force of pressing the pawl; and a guide portion rotatably provided to the support shaft, pressed to rotate by the release lever, and guiding movement of a projection pin provided to the pawl.

The latch gear may include: a latch body formed with the mounting groove and rotatably disposed on the base; a first locking portion protruding from a lateral surface of the latch body and adjoining the pawl at a first locking location; and a second locking portion separated from the first locking portion, protruding from the lateral surface of the latch body, and adjoining the pawl at a second locking location.

The pawl may include: a pawl body provided with the projection pin and having a lateral surface adjoining the release lever and the support shaft; a locking protrusion extending from one side of the pawl body and locked to a lateral surface of the latch gear as the pawl body rotates; and an extended protrusion extending from the other side of the pawl body and selectively adjoining a support lever secured to the base.

The release lever may include: a rotary portion rotatably disposed on the base and pressing the pawl at different portions thereof changed when rotated; a lever body coupled to the rotary portion to rotate together with the rotary portion and transmitting operating force manually or automatically; and a lever protrusion protruding from the lever body and pressing the guide portion.

The rotary portion may include: a rotary body into which the lever body is inserted and locked and which externally forms a first curved surface; and a rotary protrusion protruding from an outer surface of the rotary body, adjoining the lateral surface of the pawl, and externally forming a second curved surface.

The guide portion may include: a guide body through which the support shaft passes; a guide projection extending from the guide body and forming an inner space in which the projection pin moves; and a guide plate protruding from the guide body and elastically adjoining the lateral surface of the release lever.

The inner space may include an elongated hole.

The latch apparatus may further include a first elastic member supported at opposite sides thereof by the pawl and the release lever, and pressing the pawl and the release lever to rotate in different directions.

The latch apparatus may further include: a movable connecting member connected to the release lever and moving together with the release lever; and a coupling forming an operation space in which the movable connecting member is locked and moved, and moved by operating force received from a handle element.

BRIEF DESCRIPTION OF THE DRAWINGS

The above and other aspects, features and advantages of the invention will become apparent from the detailed description of exemplary embodiments given in conjunction with the accompanying drawings, in which.

DETAILED DESCRIPTION

Hereinafter, exemplary embodiments of the present invention will be described in detail with reference to the accompanying drawings. It should be noted that the drawings are not to precise scale and may be exaggerated in thickness of lines or size of components for descriptive convenience and clarity. In addition, the terms used herein are defined by taking functions of the present invention into account and can be changed according to user or operator custom or intention. Therefore, the terms should be defined according to the overall disclosure set forth herein.

Figure 1:
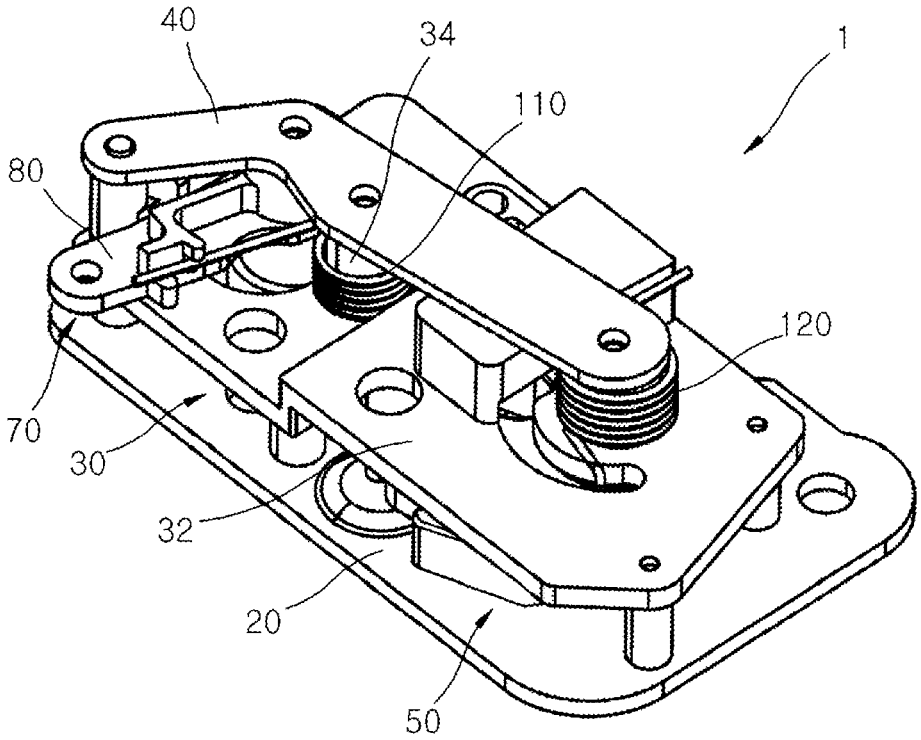
FIG. 1 is a schematic perspective view of a latch apparatus according to one embodiment of the present invention.
Figure 2:
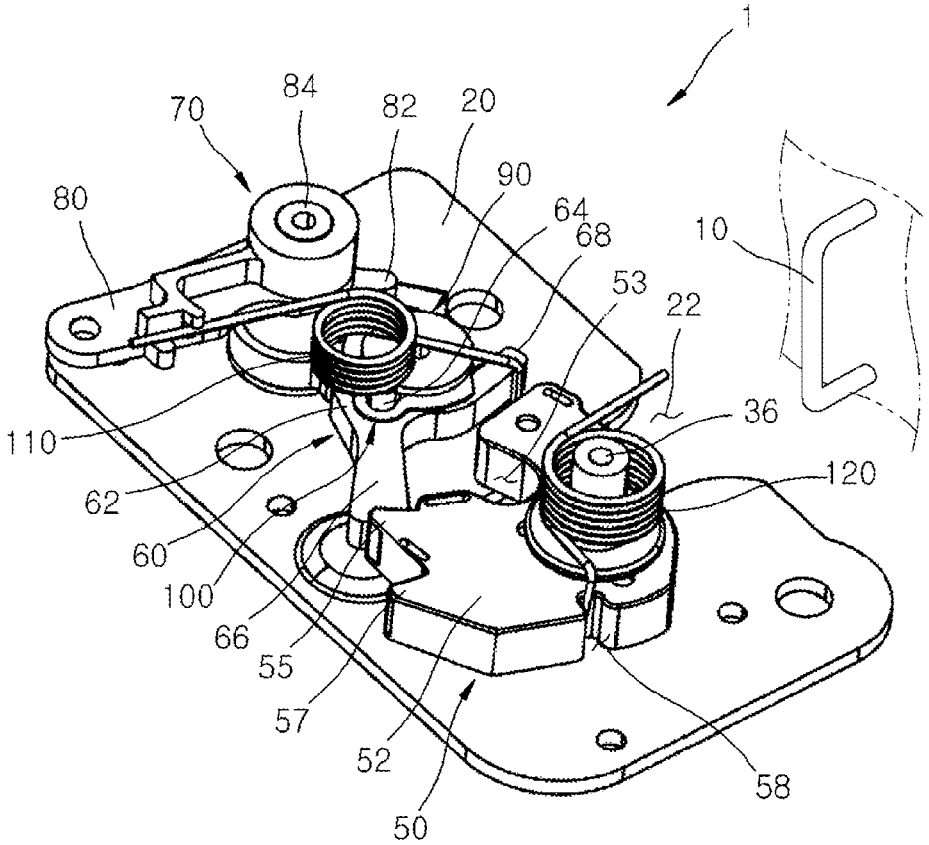
FIG. 2 is a schematic perspective view of a main configuration of the latch apparatus according to the embodiment of the present invention.
Figure 3:
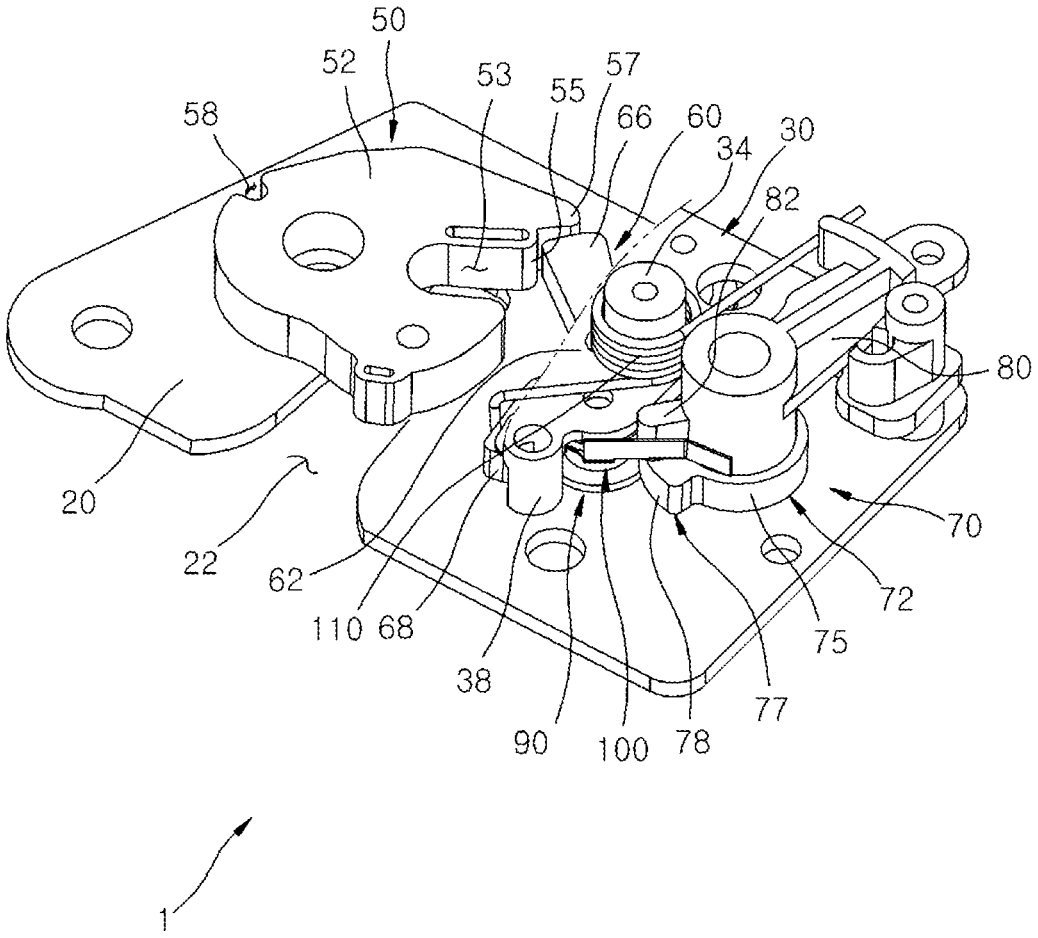
FIG. 3 is a schematic perspective view of the latch apparatus according to the embodiment of the present invention, in which a first elastic member is disposed on a first support shaft.
Figure 4:
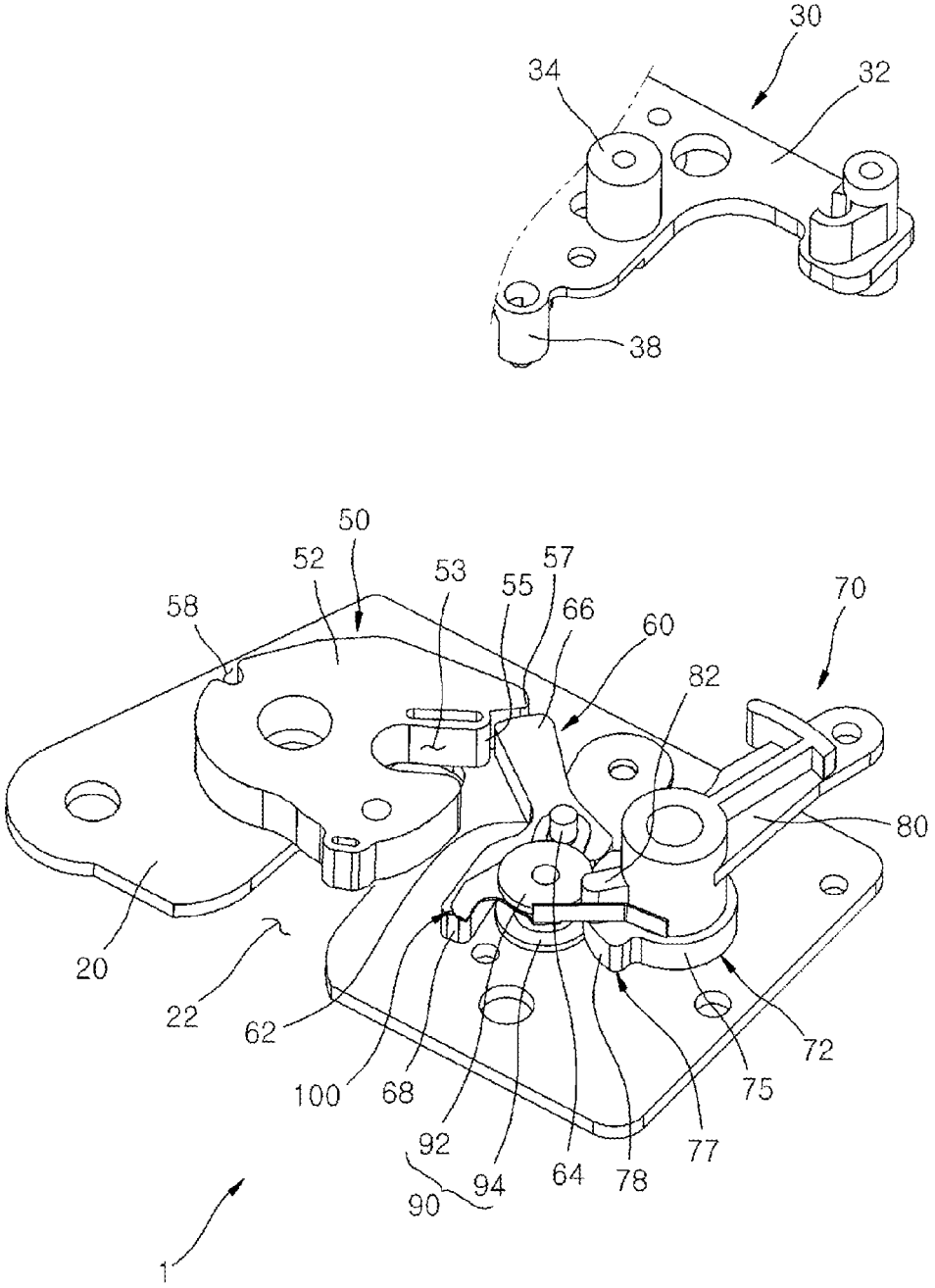
FIG. 4 is a schematic perspective view of the latch apparatus according to the embodiment of the present invention, in which a housing is separated from a base.
Figure 5:
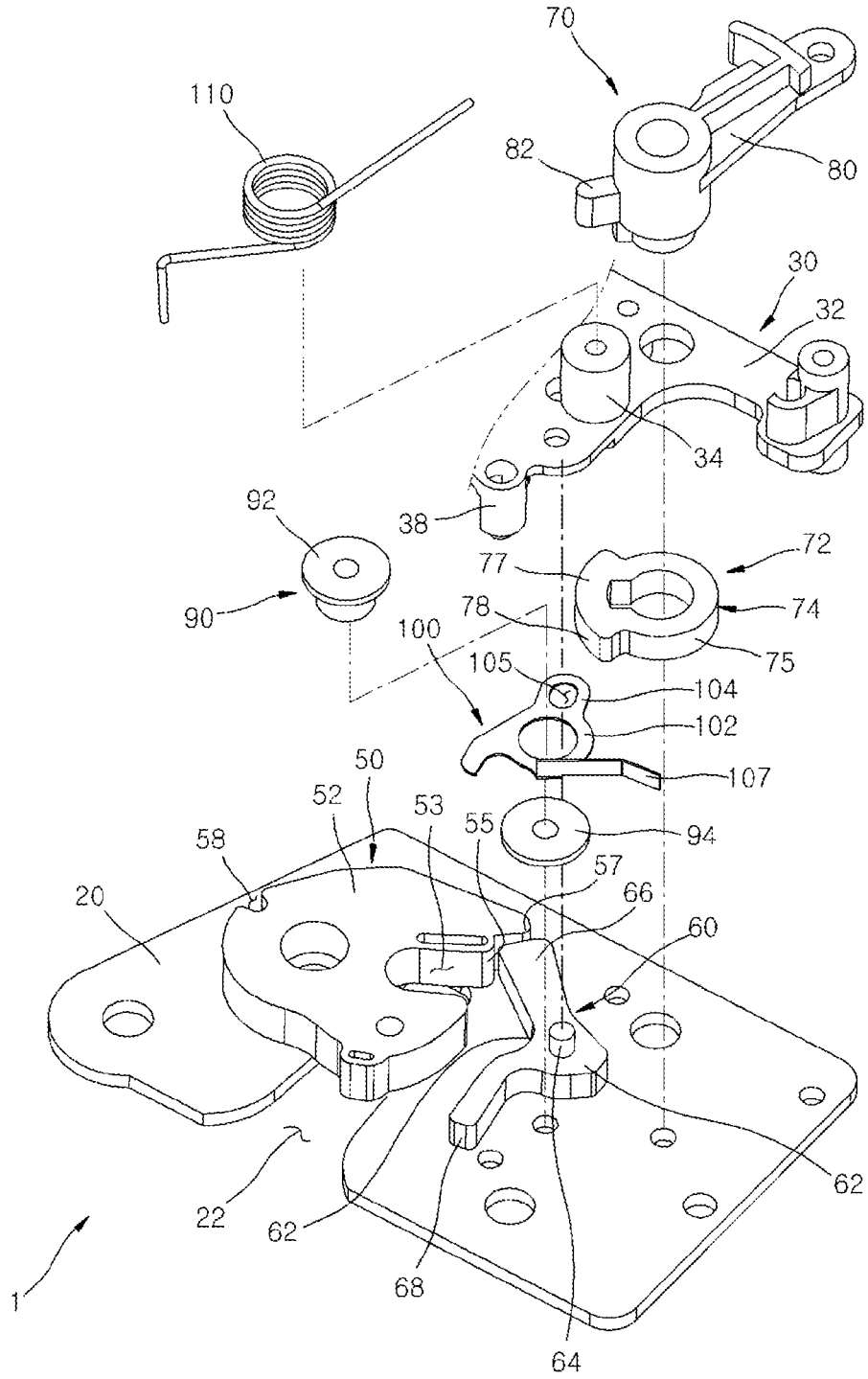
FIG. 5 is an exploded perspective view of the latch apparatus according to the embodiment of the present invention.
Figure 6:
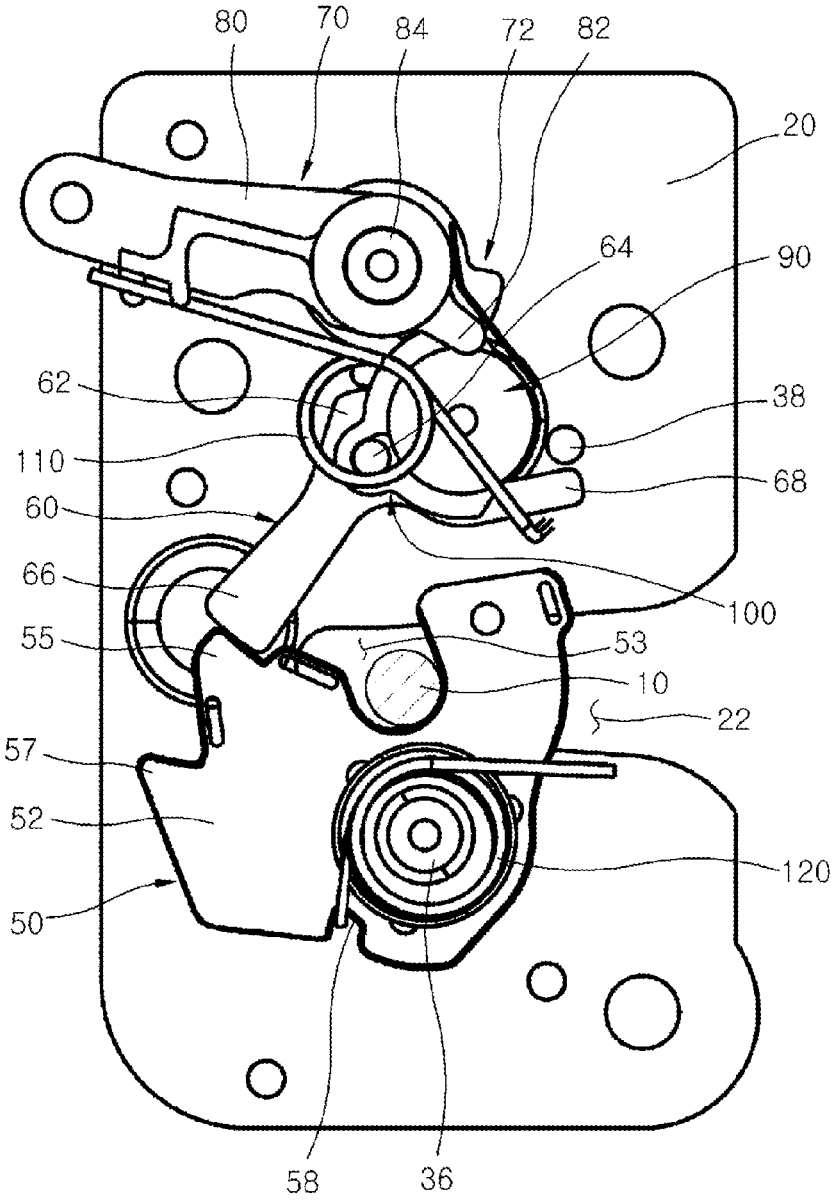
FIG. 6 is a schematic plan view of the latch apparatus according to the embodiment of the present invention.
Figure 7:
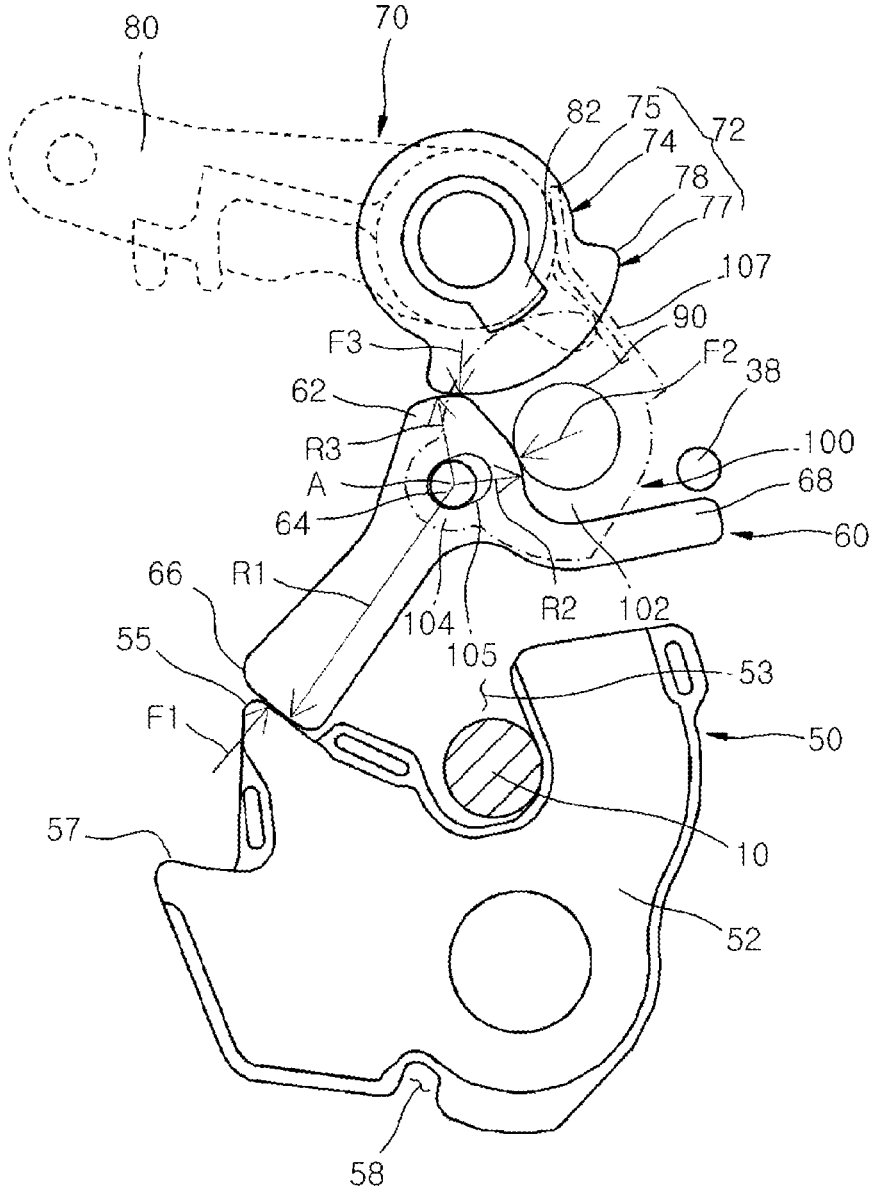
FIG. 7 is a view illustrating forces applied to a latch gear at a second locking location in which the latch gear is completely locked, in the latch apparatus according to the embodiment of the present invention.
Figure 8:
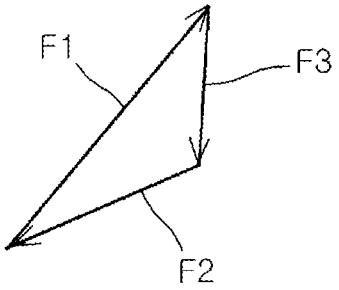
FIG. 8 is a force diagram showing a constraint force, a first reaction force and a second reaction force shown in FIG. 7.

FIG. 1 is a schematic perspective view of a latch apparatus according to one embodiment of the present invention; FIG. 2 is a schematic perspective view of a main configuration of the latch apparatus according to the embodiment of the present invention; FIG. 3 is a schematic perspective view of the latch apparatus according to the embodiment of the present invention, in which a first elastic member is disposed on a first support shaft; FIG. 4 is a schematic perspective view of the latch apparatus according to the embodiment of the present invention, in which a housing is separated from a base; FIG. 5 is an exploded perspective view of the latch apparatus according to the embodiment of the present invention; FIG. 6 is a schematic plan view of the latch apparatus according to the embodiment of the present invention; FIG. 7 is a view illustrating a force applied to a latch gear at a second locking location in which the latch gear is completely locked, in the latch apparatus according to the embodiment of the present invention; FIG. 8 is a force diagram showing a constraint force, a first reaction force and a second reaction force shown in FIG. 7; FIGS. 9*a* to 9*f* are views showing a locking sequence of the latch apparatus according to the embodiment of the present invention; and FIGS. 10*a* to 10*e* are views showing an opening sequence of the latch apparatus according to the embodiment of the present invention.

Referring to FIGS. 1 to 7, a latch apparatus 1 according to one exemplary embodiment of the invention includes a base 20 formed with an opening 22; a latch gear 50 formed with a mounting groove 53 to lock a striker 10 entering the mounting groove through the opening 22; a pawl 60 rotatably disposed on the base 20 and engaging with the latch gear 50 to prevent rotation of the latch gear 50; a release lever 70 disposed to adjoin the pawl 60, transmitting constraint force F1 to press the pawl 60, and rotating the pawl 60 to release the latch gear 50; a support shaft 90 secured to the base 20, supporting a lateral surface of the pawl 60 and transmitting the constraint force F1 to press the pawl 60; and a guide portion 100 rotatably provided to the support shaft 90, pressed to rotate by the release lever 70, and guiding movement of a projection pin 64 provided to the pawl 60.

In one embodiment, the base 20 and the cover plate 40 are formed of flat metal plates, and the cover plate 40 and the base 20 are connected to each other by a spindle-shaped rivet.

Other components of the latch apparatus 1 are disposed between the base 20 and the cover plate 40 so as to lock or release the striker 10.

In one embodiment, the base 20 is fastened to a vehicle door, and includes the opening 22 having a 'U'-shape at one side thereof at which the striker 10 moves.

The striker 10 mounted on a chassis of a vehicle enters the opening 22 and is engaged with the latch gear 50.

A housing 30 is placed between the base 20 and the cover plate 40, and includes a first support shaft 34 for supporting a first elastic member 110.

In one embodiment, the housing 30 includes a housing body 32, the first support shaft 34, and a support lever 38.

The housing body 32 is separated from the base 20 to be placed above the base 20 (see FIG. 1), and the latch gear 50 and the pawl 60 are rotatably disposed between the base 20 and the housing body 32.

The first support shaft 34 protrudes upward from the housing body 32, and the support lever 38 protrudes downward from the housing body 32 and is coupled to the base 20.

The first elastic member 110 has a coil spring shape and is disposed outside the first support shaft 34. Further, the first elastic member 110 is supported at one side thereof (a left side in FIG. 6) on the lever body 80 of the release lever 70, and at the other side thereof (a right side in FIG. 6) on the body of the pawl 60.

The support lever 38 protrudes downward from the housing body 32 and is coupled to the base 20 to be disposed on a route in which an extended protrusion 68 of the pawl 60 is rotated. Thus, when the extended protrusion 68 is rotated toward the support lever 38, rotation of the extended protrusion 68 is restricted while adjoining the support lever 38, and the pawl 60 is rotated clockwise about the support lever 38.

A second support shaft 36 rotatably securing the latch gear 50 to the base 20 protrudes upward from the housing body 32 and is inserted into the second elastic member 120.

The second elastic member 120 having a coil spring shape is disposed outside the second support shaft 36. Further, the second elastic member 120 is supported at one side thereof (a right side in FIG. 6) on a portion protruding upward from the housing body 32, and the other side (a lower side in FIG.

6) of the second elastic member 120 is inserted into a locking groove 58 of the latch gear 50.

As the latch gear 50 is rotated, the other side of the second elastic member 120 is rotated in an arc shape with respect to the second support shaft 36. To guide rotation of the other side of the second elastic member 120, the housing body 32 is formed with a guide hole having an arc shape such that the second elastic member 120 can stably move.

The latch gear 50 may have any shape so long as the latch gear 50 can be rotatably disposed on the base 20 to lock the striker 10 entering the mounting groove 53 through the opening 22.

In one embodiment, the latch gear 50 includes: a latch body 52 formed with the mounting groove 53 and rotatably disposed on the base 20; a first locking portion 55 protruding from a lateral surface of the latch body 52 and adjoining the pawl 60 at a first locking location; and a second locking portion 57 separated from the first locking portion 55, protruding from the lateral surface of the latch body 52, and adjoining the pawl 60 at a second locking location.

The latch body 52 forming the body of the latch gear 50 is rotatably disposed on the base 20 by the second support shaft 36.

The latch body 52 is formed at one side thereof with the mounting groove 53, in which the other side of the second elastic member 120 is inserted, and is formed at the other side thereof with the first locking portion 55 and the second locking portion 57.

Thus, the striker 10 is inserted into the mounting groove 53 forming an inward groove in the latch body 52.

The first locking portion 55 and the second locking portion 57 are successively formed next to the mounting groove 53. When a locking protrusion 66 of the pawl 60 is locked to the first locking portion 55 protruding outward from the latch body 52, the latch apparatus 1 is in a completely locked state at the second locking location.

In addition, when the locking protrusion 66 of the pawl 60 is locked to the second locking portion 57 protruding outward from the latch body 52, the latch apparatus 1 is in a safely locked state at the first locking location.

The second locking location corresponds to a state wherein the striker 10 is completely locked to the latch gear 50, and the first locking location corresponds to a state wherein the latch gear 50 and the striker 10 are coupled to each other before the striker 10 is separated from the latch gear 50 or the striker 10 is completely coupled to the latch gear 50.

The pawl 60 may have various shapes so long as the pawl 60 can be rotatably disposed on the base 20 and engage with the latch gear 50 to prevent rotation of the latch gear 50.

In one embodiment, the pawl 60 includes: a pawl body 62 provided with the projection pin 64 and having a lateral surface adjoining the release lever 70 and the support shaft 90; the locking protrusion 66 extending from one side of the pawl body 62 and locked to the lateral surface of the latch gear 50 as the pawl body 62 rotates; and the extended protrusion 68 extending from the other side of the pawl body 62 and selectively adjoining the support lever 38 secured to the base 20.

The projection pin 64 protrudes upward from the pawl body 62 forming the body of the pawl 60, and the locking protrusion 66 protruding from the one side of the pawl body 62 is engaged with the first locking portion 55 or the second locking portion 57 of the latch gear 50 to prevent rotation of the latch gear 50.

The extended protrusion 68 protruding from the pawl body 62 in a different direction than the locking protrusion 66 is rotated together with the pawl body 62. When the extended protrusion 68 is prevented from rotation while adjoining the support lever 38, the pawl body 62 is rotated by the support lever 38 acting as a lever.

The pawl 60 is rotated together with the release lever 70 receiving operating force from a handle.

In addition, a lower side of the pawl 60 is not secured to the base 20 and thus slides on the base 20.

The lateral surface of the pawl 60 is disposed to adjoin the release lever 70 and the support shaft 90. Constraint force F1 transmitted to the latch gear 50 while the pawl 60 prevents rotation of the latch gear 50 is distributed to the release lever 70 and the support shaft 90.

Therefore, the release lever 70 is rotated by a force weaker than the constraint force F1, and the pawl 60 is rotated by rotation of the release lever 70, thereby allowing rotation of the latch gear 50.

The release lever 70 may have any shape so long as the release lever 70 can be disposed to adjoin the pawl 60, transmit the constraint force F1 to press the pawl 60, and release the latch gear 50 by rotating the pawl 60.

In one embodiment, the release lever 70 includes: a rotary portion 72 rotatably disposed on the base 20 and pressing the pawl 60 at different portions thereof changed when rotated; a lever body 80 coupled to the rotary portion 72 to rotate together with the rotary portion 72 and transmitting operating force manually or automatically; and a lever protrusion 82 protruding from the lever body 80 and pressing the guide portion 100.

The release lever 70 receives the operating force of the handle provided to the door, and includes the lever body 80 rotated by external force, and the rotary portion 72 connected to the lever body 80 and rotating together with the lever body 80.

A portion of the rotary portion 72 adjoining the pawl 60 varies while the rotary portion rotates together with the lever body 80, and thus, the rotary portion 72 may have any shape so long as the rotary portion can control rotation of the pawl 60.

In one embodiment, the rotary portion 72 may include: a rotary body 74 into which the lever body 80 is inserted and locked and which externally forms a first curved surface 75; and a rotary protrusion 77 protruding from an outer surface of the rotary body 74, adjoining the lateral surface of the pawl 60, and externally forming a second curved surface 78.

Since a projection protruding downward from the lever body 80 is inserted into and key-coupled to the rotary body 74, the rotary body 74 is rotated together with the lever body 80.

The first curved surface 75 having an arc shape is formed outside the rotary body 74, and the rotary protrusion 77 protruding in a lateral direction of the rotary body 74 protrudes in a fan shape with respect to the center of the rotary protrusion 77.

The lever protrusion 82 protruding in the lateral direction of the rotary body 74 moves the guide plate 107 of the guide portion 100, such that the projection pin 64 can move by movement of the guide portion 100.

The second curved surface 78 having an arc shape is formed outside the rotary protrusion 77, and the rotary protrusion 77 adjoins the protruded lateral surface of the pawl body 62 while being rotated by rotation of the rotary portion 72 with respect to the release lever shaft 84.

The release lever shaft 84 is secured to the base 20 while penetrating the rotary body 74 and the lever body 80, whereby the rotary body 74 and the lever body 80 can be rotated about the release lever shaft 84.

One end of the release lever shaft 84 is secured to the base 20, and the other end thereof is coupled to the cover plate 40.

The support shaft 90 may have various shapes so long as the support shaft can be secured to the base 20, support the lateral surface of the pawl 60, and facilitate releasing operation for the pawl 60 while receiving the constraint force F1 of pressing the pawl 60 together with the rotary portion 72 of the release lever 70.

In one embodiment, the support shaft 90 includes a second support shaft member 94 secured to the base 20, and a first support shaft member 92 coupled to an upper side of the second support shaft member 94 with the guide portion 100 disposed therebetween.

The guide portion 100 may have various shapes so long as the guide portion can be rotatably provided to the support shaft 90 and pressed to rotate by the release lever 70, thereby guiding movement of the projection pin 64 provided to the pawl 60.

In one embodiment, the guide portion 100 may include: a guide body 102 through which the support shaft 90 passes; a guide projection 104 extending from the guide body 102 and forming an inner space 105 in which the projection pin 64 moves; and the guide plate 107 protruding from the guide body 102 and elastically adjoining the lateral surface of the release lever 70.

The guide portion 100 is made of a metal plate and is rotatably provided to the support shaft 90 secured to the base 20.

The support shaft 90 passes through the guide body 102 forming the body of the guide portion 100, and the inner space 105 having an elongated hole shape is formed inside the guide projection 104 protruding laterally from the guide body 102.

The projection pin 64 of the pawl 60 passes through the inner space 105, and may be moved within the inner space 105 having an elongated hole shape.

The inner space 105 provides a space in which the projection pin 64 is freely movable to some extent.

Since the location of the inner space 105 is varied depending upon rotation of the guide portion 100, rotation of the pawl 60 about the projection pin 64 placed in the inner space 105 is also varied.

Here, a leaf spring having elasticity is used as the guide plate 107 protruding from the guide body 102, and thus, the guide plate 107 may elastically adjoin the lower side of the lever body 80.

The lever protrusion 82 of the release lever 70 is interposed between the guide plate 107 and the guide body 102, and the guide plate 107 elastically adjoins the lever protrusion 82 and the lever body 80.

The first elastic member 110 is supported at opposite sides thereof by the pawl 60 and the release lever 70, and forces the pawl 60 and the release lever 70 to rotate in different directions.

That is, one side of the first elastic member 110 provides elasticity that urges the lever body 80 of the release lever 70 to rotate in one direction (the clockwise direction in FIG. 6). In addition, the other side of the first elastic member 110 provides elasticity that urges the extended protrusion 68 of the pawl 60 to rotate in the other direction (the counterclockwise direction in FIG. 6).

The second elastic member 120 is supported at one side thereof by the housing 30 and is prevented from moving, and the other side of the second elastic member 120 is inserted into the locking groove 58 of the latch gear 50 and provides elasticity that urges the latch gear 50 to rotate in one direction (the clockwise direction in FIG. 6).

FIG. 7 shows forces acting on the pawl 60 in a completely locked state of the second locking location. The release lever 70 is illustrated by a dotted line, and the guide portion 100 is illustrated by a dash-dotted line.

Load due to a door seal disposed along an edge of the door causes torque on the latch gear 50.

Thus, constraint force F1 is transmitted to the surface of the pawl 60 having a first radius R1 from a pin center A of the projection pin 64 to one end of the locking protrusion 66 adjoining the latch gear 50.

A distance from the pin center A of the projection pin 64 to the pawl body 62 adjoining the support shaft 90 is set as a second radius R2, and a distance from the pin center A to the pawl body 62 adjoining the rotary portion 72 is set as a third radius R3.

First reaction force F2 is created on the support shaft 90 adjoining the pawl body 62, and second reaction force F3 is created on the rotary portion 72 adjoining the pawl body 62.

All of the constraint force F1, the first reaction force F2 and the second reaction force F3 pass through the pin center A of the projection pin 64, and thus, no torque is applied to the pawl 60. In addition, since the first radius R1, the second radius R2 and the third radius R3 have a center placed at the pin center A of the projection pin 64, no load is applied to the projection pin 64.

FIG. 8 shows a force diagram in which the second reaction force F3 is smaller than the constraint force F1.

The release lever 70 operated to release the latch gear 50 is rotated in the counterclockwise (see FIG. 10*b*) by operation of the door handle.

Since the rotary portion 72 provided to the release lever 70 is also rotated, the shape of the rotary portion 72 supporting the lateral surface of the pawl 60 is changed and thus, the pawl 60 is rotated in association with the rotary portion 72.

Since the second reaction force F3 is smaller than the constraint force F1, and friction for releasing the constraint force F1 is smaller than that for releasing the second reaction force F3, the pawl 60 can be rotated by rotating the release lever 70 with a force weaker than the constraint force F1.

FIG. 7 shows whether the rotation center of the pawl 60 is maintained to substantially correspond to the pin center A of the projection pin 64. A distance between the outer surface of the pawl 60 adjoining the support shaft 90 and the projection pin 64 placed at one side of the inner space 105 of the guide portion 100 is limited to a value a slightly greater than the second radius R2.

A distance between the lateral surface of the pawl body 62 adjoining the rotary portion 72 and the projection pin 64 may be kept to the third radius R3 by the guide portion 100 pressing the projection pin 64 in a direction of adjoining the rotary portion 72.

Since the location of the guide portion 100 is adjusted by the guide plate 107 having elasticity and adjoining the release lever 70, the projection pin 64 inserted into the inner space 105 and the pawl 60 connected to the projection pin 64 are pressed in a direction of adjoining the rotary portion 72 of the release lever 70.

The area of the pawl body 62 adjoining the first curved surface 75 or the second curved surface 78 of the rotary portion 72 and sliding thereon is smaller than that of the locking protrusion 66 adjoining the lateral surface of the latch gear 50. Thus, force needed for movement of the release lever 70 is less than that of a conventional latch apparatus.

When the rotary portion 72 is rotated and moved in a direction of being separated from the pawl body 62, the latch gear 50 pushes the pawl 60 in a direction of transmitting the constraint force F1, and the lateral surface of the pawl body 62 slides and moves on the surface of the support shaft 90 about the support shaft 90.

The extended protrusion 68 of the pawl 60 generates torque in the clockwise direction about the support lever 38 while adjoining the support lever 38 and thus being restricted from moving toward the support lever 38.

The lever protrusion 82 protruding from the release lever 70 presses the guide plate 107 of the guide portion 100, and movement of the guide plate 107 allows the guide body 102 to move in the clockwise direction.

Such movement of the guide body 102 presses the projection pin 64 upward in the inner space 105, thereby increasing moment about the support shaft 90.

Movement in the direction of transmitting the constraint force F1 to the pawl 60 and rotation of the pawl 60 in the counterclockwise direction about the support shaft 90 are continued until the pawl 60 is separated from the latch gear 50.

Figure 10A:
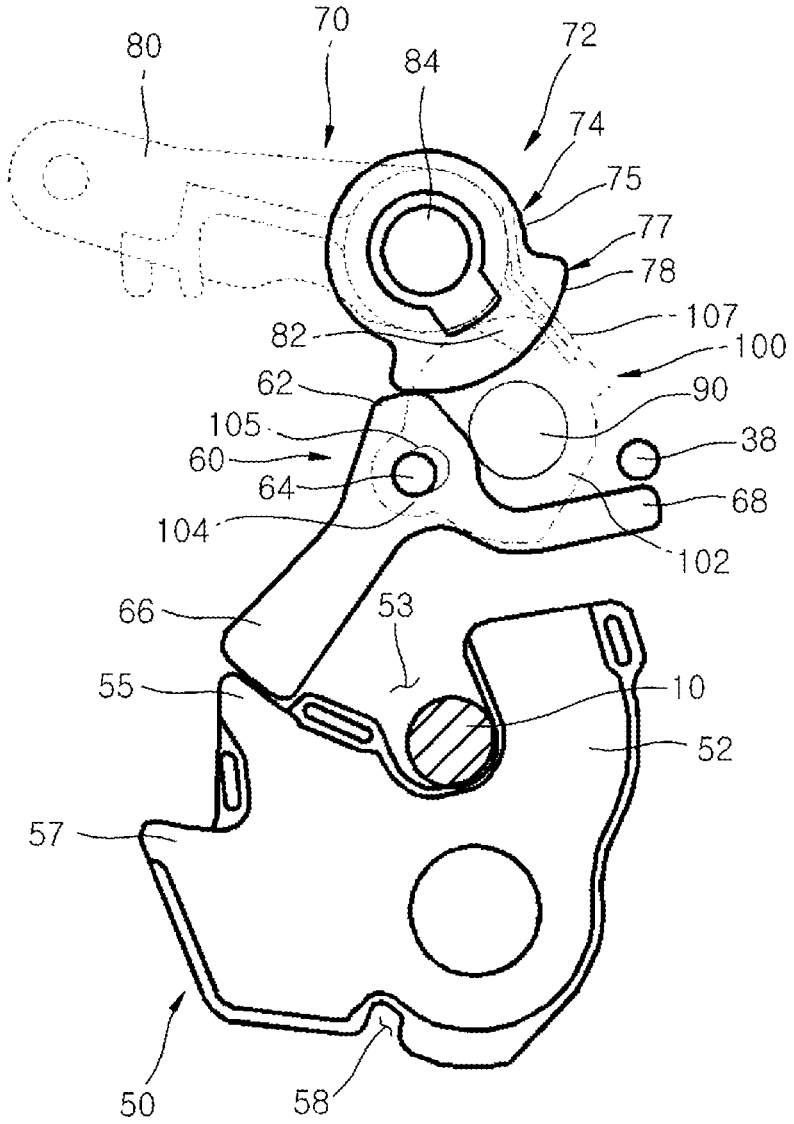
FIGS. 10*a* to 10*e* are views showing an opening sequence of the latch apparatus according to the embodiment of the present invention.
Figure 10B:
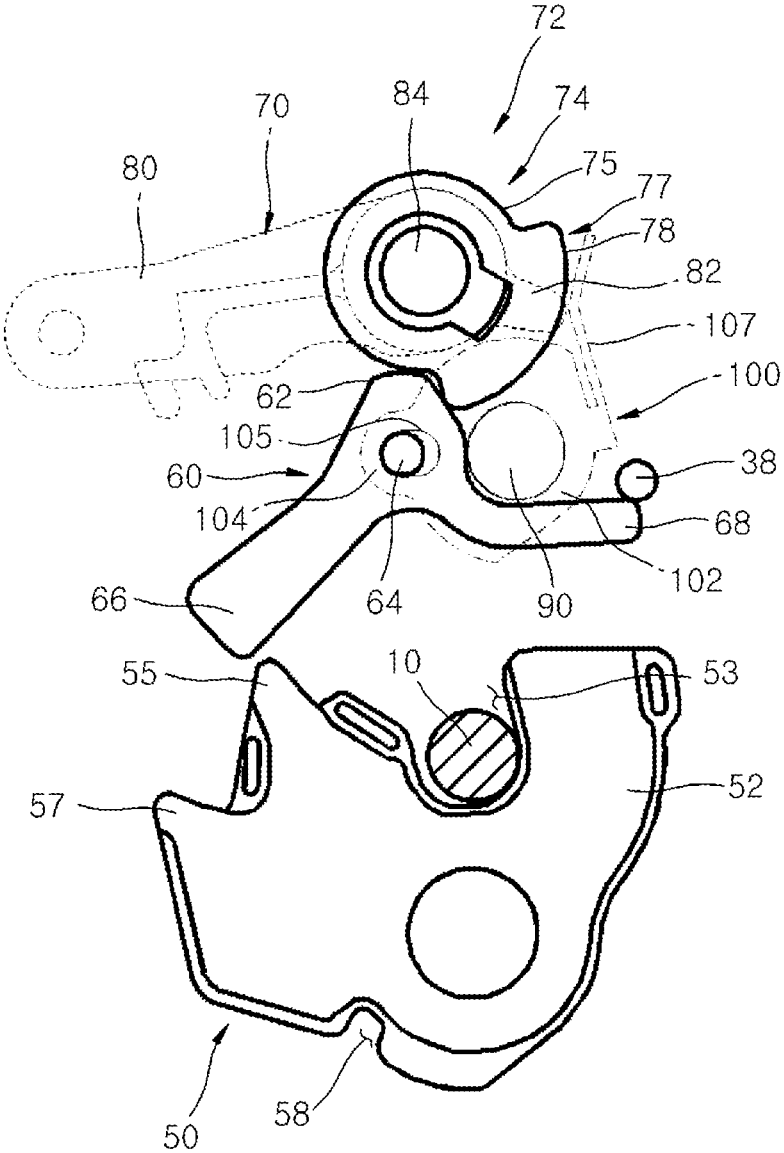
Figure 10C:
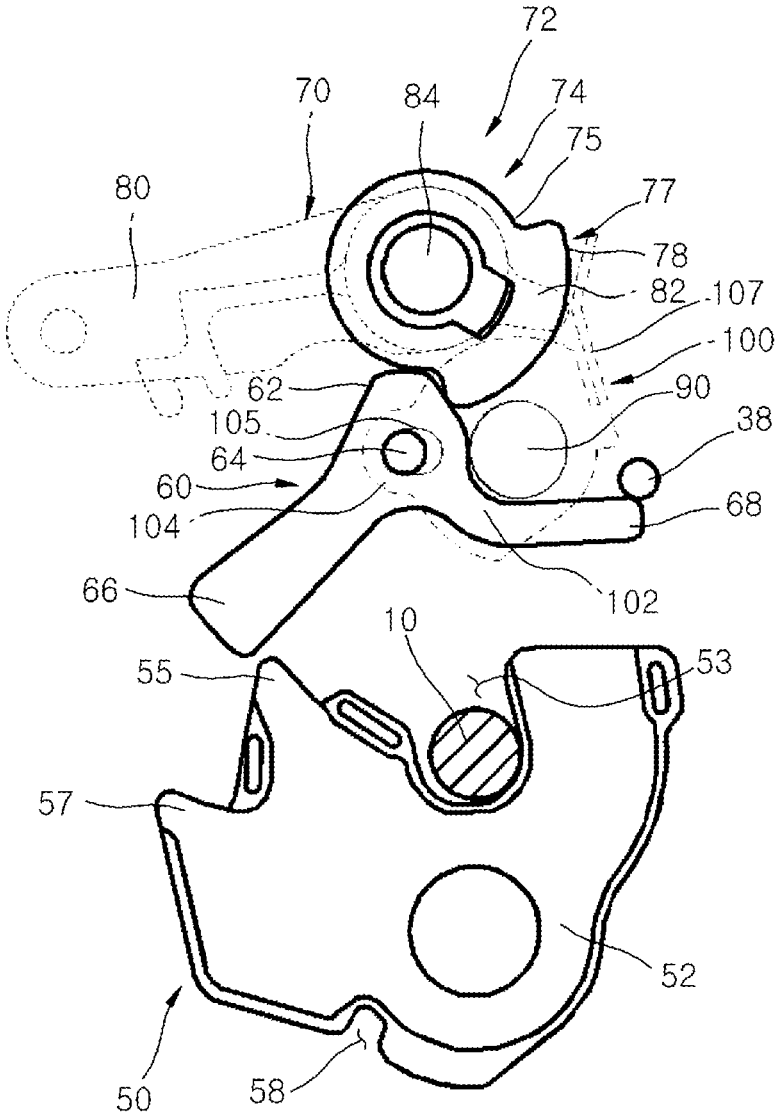
Figure 10D:
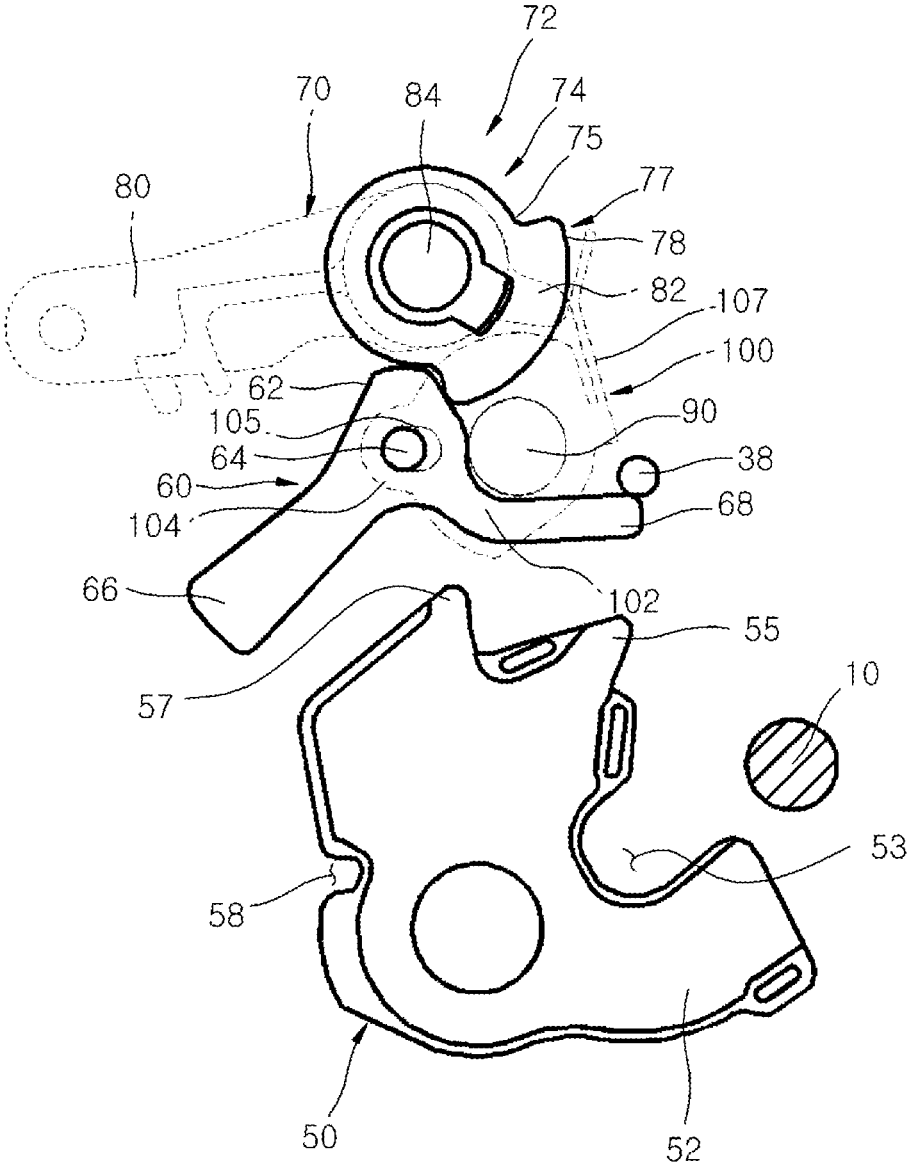

The latch gear 50 is separated from the pawl 60 and rotated clockwise to face an opening location, as shown in FIGS. 10*c* and 10*d*.

When the latch gear 50 is rotated, the pawl 60 is kept stationary at the location as shown in FIG. 10*d*.

Since the release lever 70 is at the operating location and the lever protrusion 82 of the release lever 70 pushes the guide plate 107 of the guide portion 100, the projection pin 64 of the pawl 60 placed in the inner space 105 of the guide portion 100 is kept at a preset location.

Leftward movement of the pawl 60 is prevented by the projection pin 64 placed at the left side in the inner space 105, and rightward movement of the pawl 60 is prevented by the support shaft 90.

Figure 10E:
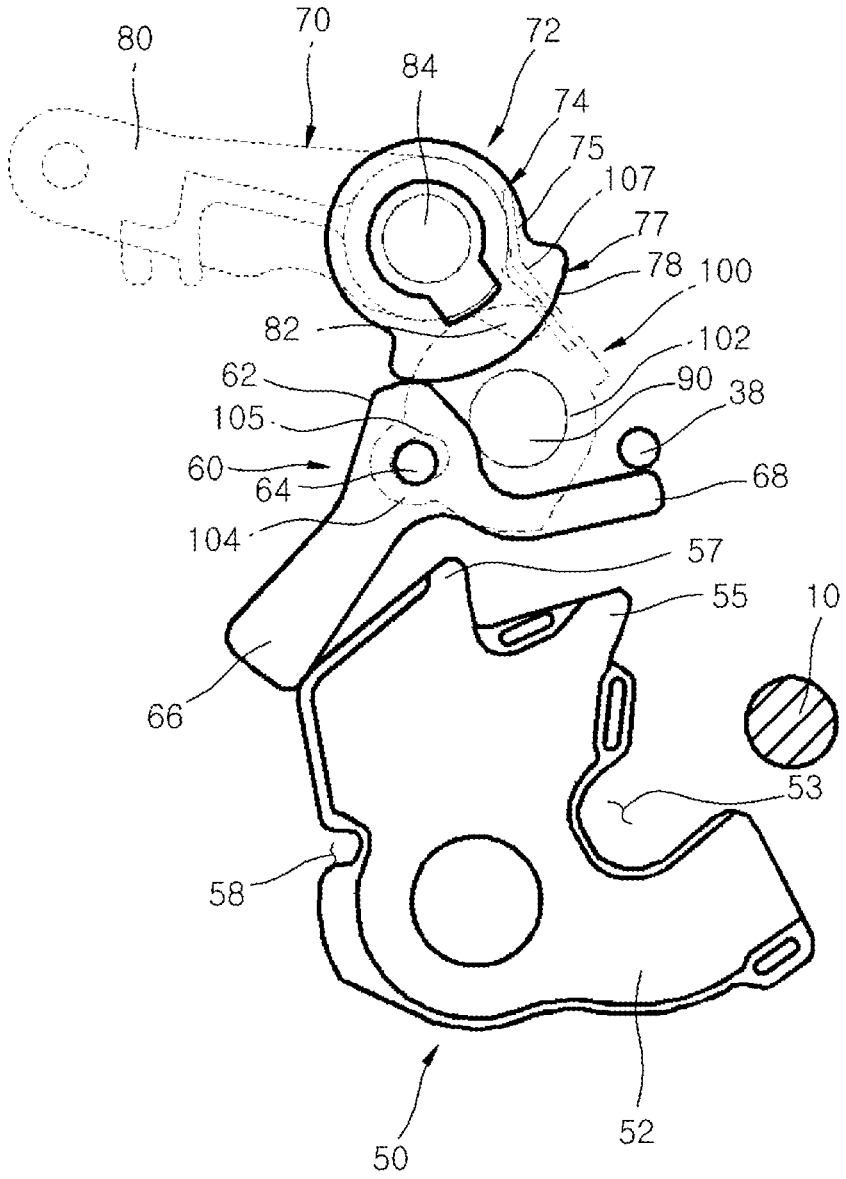

After the latch gear 50 moves to a release location, the handle of the door is returned to a stationary location by a user. The release lever 70 and the rotary portion 72 provided to the release lever 70 are rotated by elasticity of the second elastic member 120, and the pawl 60 adjoins the latch body 52 of the latch gear 50, as shown in FIG. 10*e*.

The pawl 60 is pressed to allow the surface of the rotary portion 72 and the surface of the pawl body 62 to be in contact with each other, and the projection pin 64 of the pawl 60 is moved to press the guide body 102 in the counterclockwise direction about the support shaft 90.

With the elasticity of the first elastic member 110 urging the extended protrusion 68 of the pawl 60 upwards, the pawl 60 is rotated in the counterclockwise about the support lever 38.

In addition, the lever protrusion 82 of the release lever 70 moves away from the guide plate 107, and the locking protrusion 66 of the pawl 60 presses the latch gear 50.

The release lever 70 may be rotated by drive force from a drive device, such as an electric actuator or the like, instead of the operating force transferred from the handle.

In addition, the guide plate 107 of the guide portion 100 may be pressed by a protrusion on the rotary portion 72 instead of the lever protrusion 82 of the release lever 70.

Next, operation of the latch apparatus 1 according to the embodiment of the invention will be described in detail with reference to the accompanying drawings.

Figure 9A:
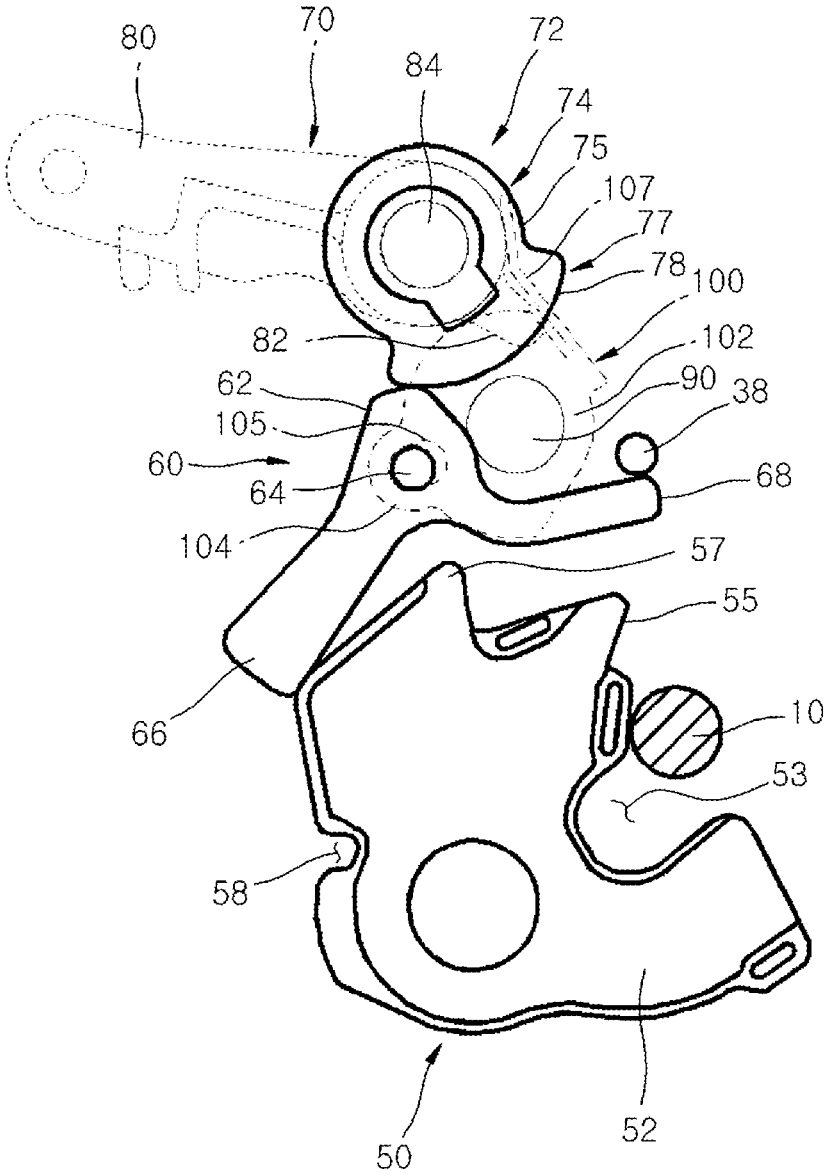
FIGS. 9*a* to 9*f* are views showing a locking sequence of the latch apparatus according to the embodiment of the present invention.

Referring to FIGS. 1, 2 and 9*a*, operation of locking the striker 10 to the latch gear 50 will be described.

The striker 10 is moved from right to left into the mounting groove 53 of the latch gear 50, and pushes the latch gear in the counterclockwise direction about the second support shaft 36 coupled between the base 20 and the cover plate 40.

Figure 9B:
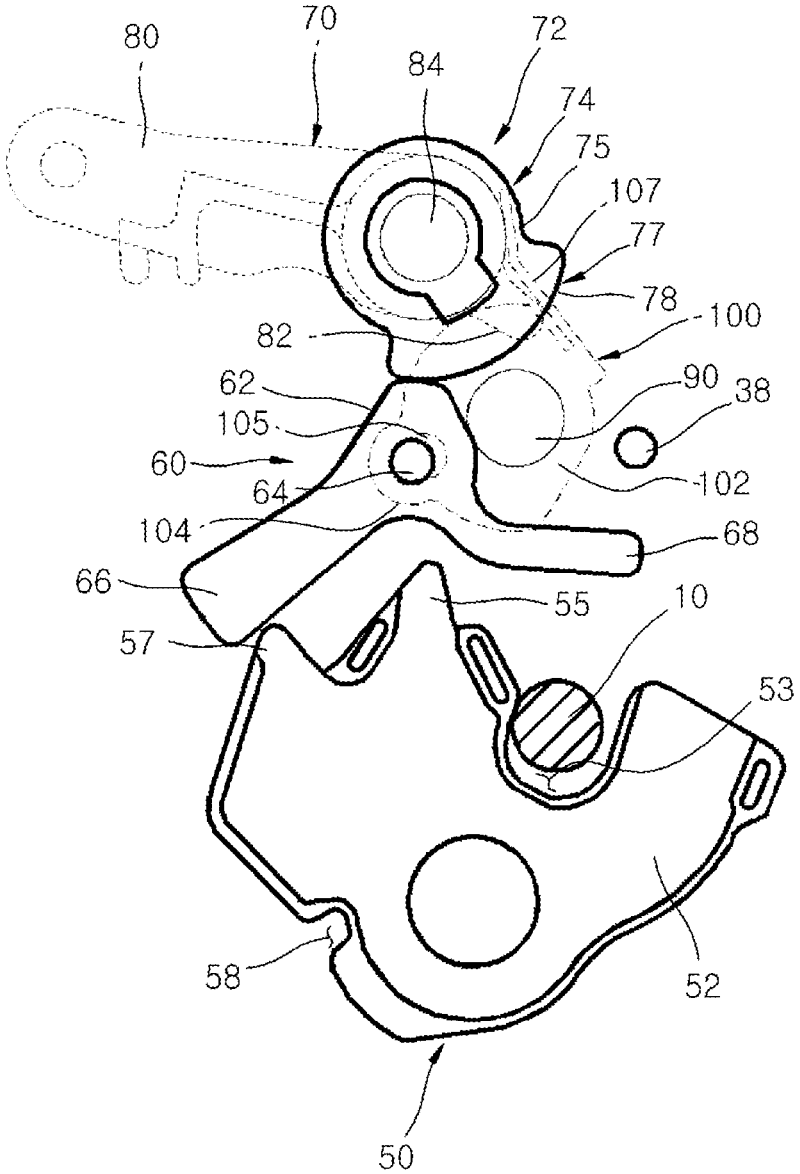

FIG. 9*b* shows that the striker 10 rotates the latch gear 50 to a location near the first locking location.

The pawl 60 pushed by the striker 10 and adjoining the rotating latch gear 50 is pushed by the latch gear 50 to rotate in the clockwise direction.

The pawl 60 is rotated again by elasticity of the first elastic member 110 in a direction of adjoining the latch gear 50.

Figure 9C:
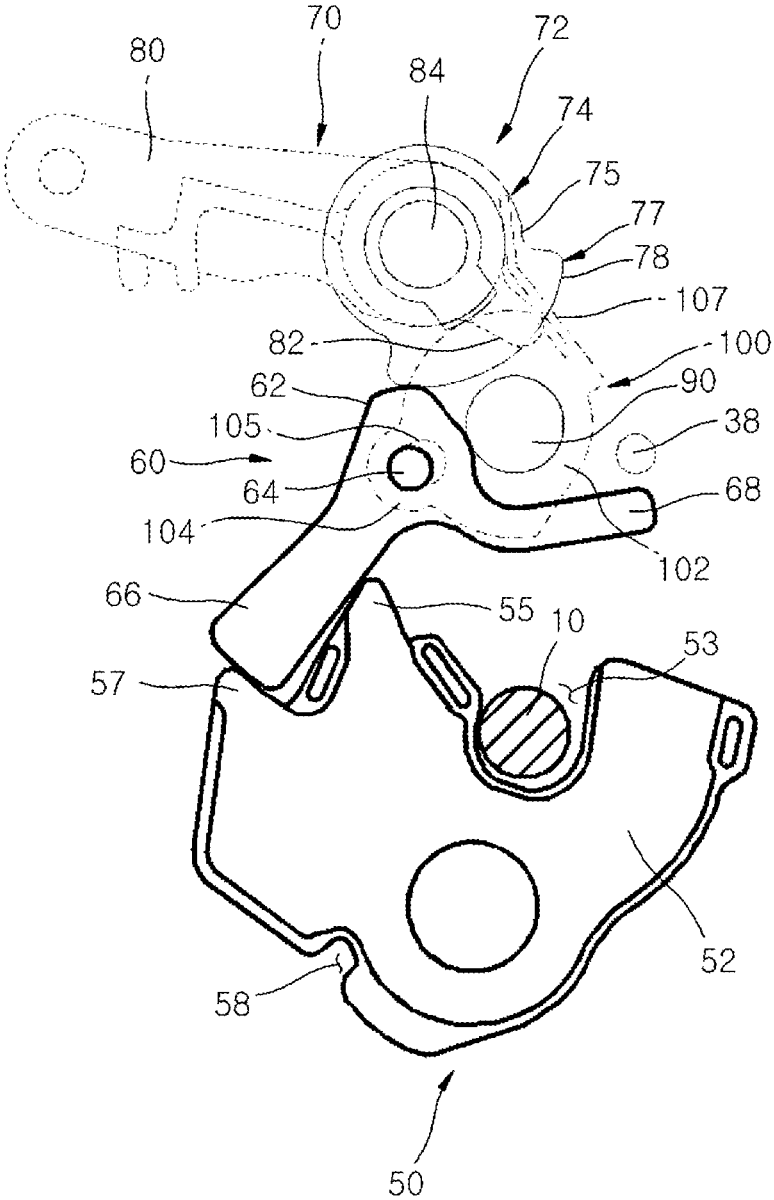

As shown in FIG. 9*c*, movement of the striker 10 causes the locking protrusion 66 of the pawl 60 to be locked to the second locking portion 57 of the latch gear 50, thereby maintaining a safely locked state at the first locking location.

Figure 9D:
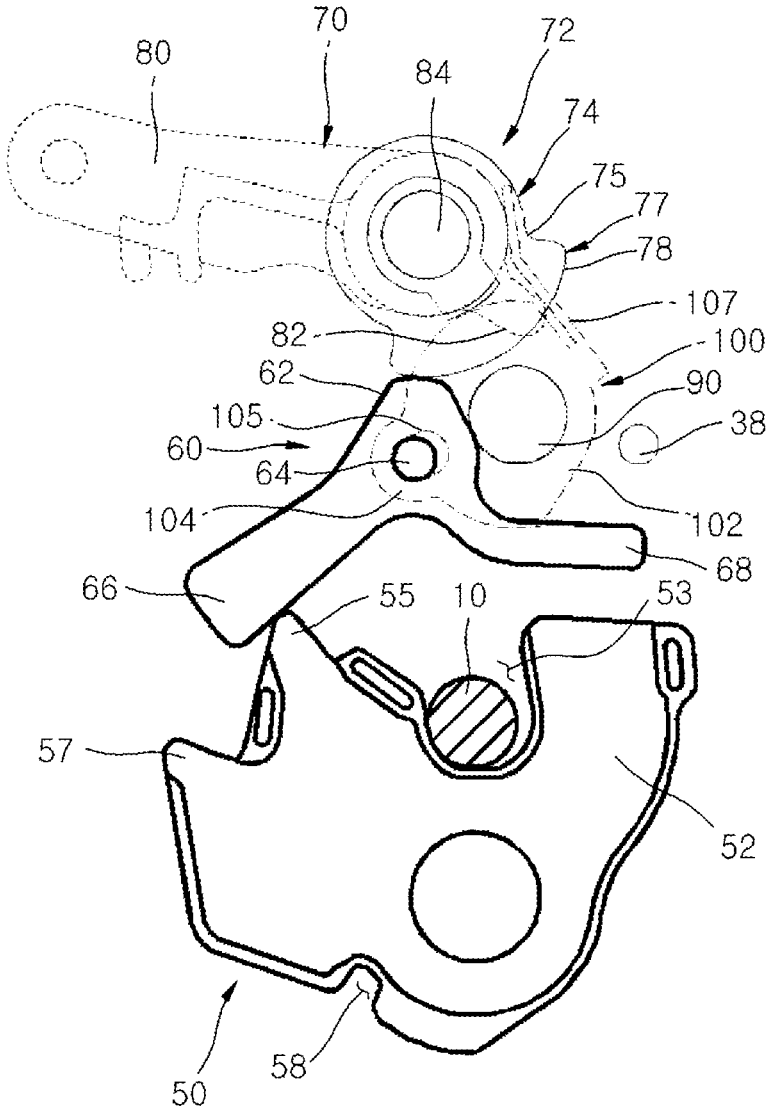

As shown in FIG. 9*d*, continuous movement of the striker 10 causes the latch gear 50 to rotate such that the locking protrusion 66 of the pawl 60 can climb over the first locking portion 55.

Figure 9E:
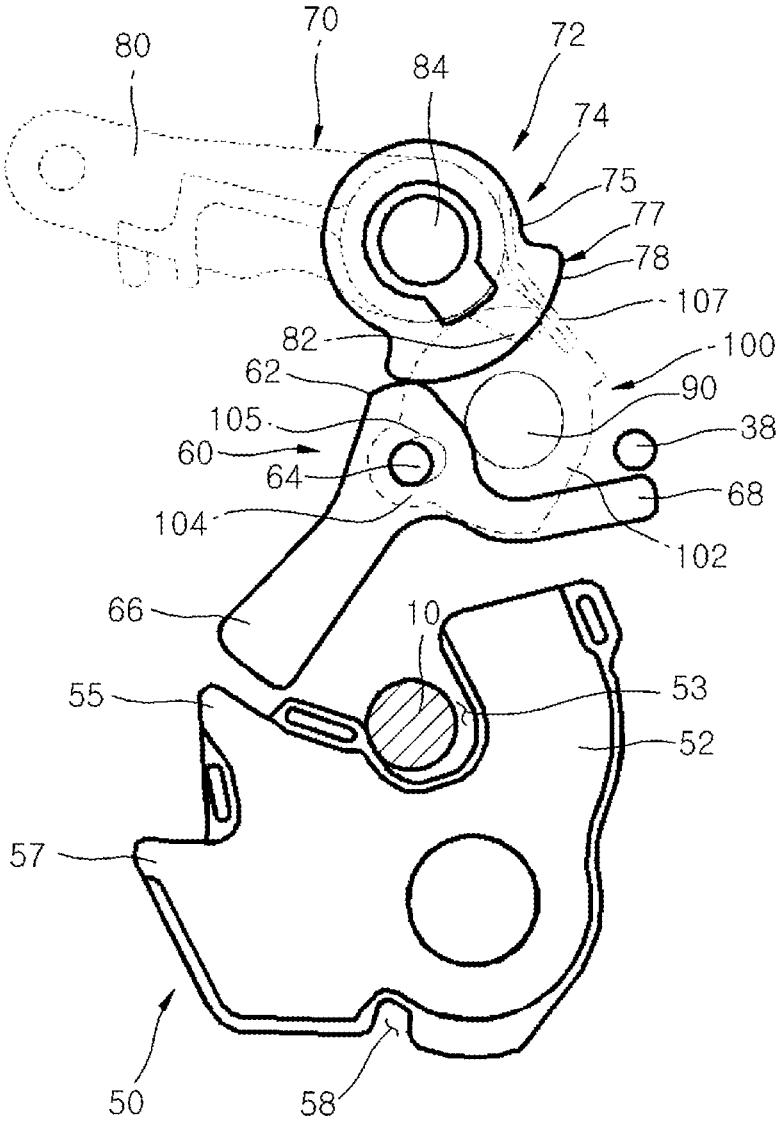

As shown in FIG. 9*e*, continuous movement of the striker 10 causes the latch gear 50 to pass through the second locking location and to be additionally rotated.

Figure 9F:
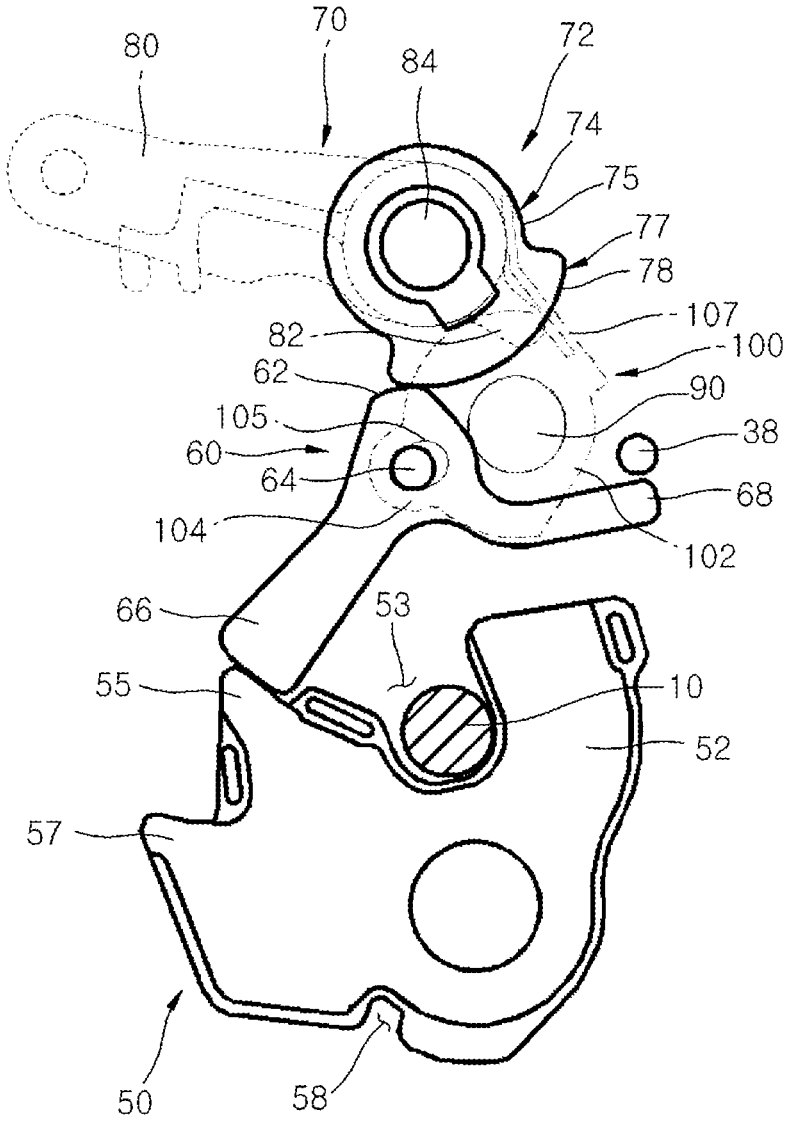

As shown in FIG. 9*f*, the striker 10 is locked to the latch gear 50 in a state that the locking protrusion 66 of the pawl 60 is locked to the first locking portion 55.

As the door is closed, the door seal is pressed to generate elasticity, which is transmitted to the pawl 60 through the latch gear 50, thereby increasing the constraint force F1 in the pawl 60 and the latch gear 50.

At the first locking location of the safely locked state, rightward movement of the striker 10 is resisted by the locking protrusion 66 of the pawl 60 adjoining the second locking portion 57 of the latch gear 50, thereby preventing rotation of the latch gear 50 in the clockwise direction.

At the second locking location of the completely locked state, rightward movement of the striker 10 is resisted by the locking protrusion 66 of the pawl 60 adjoining the first locking portion 55 of the latch gear 50, thereby preventing rotation of the latch gear 50 in the clockwise direction.

The striker 10 enters the mounting groove 53 of the latch gear 50 from the opening location of the latch gear 50 to the locking location of the latch gear 50 and rotates the latch gear 50 in the counterclockwise direction.

The locking protrusion 66 of the pawl 60 climbs over the outer surface of the latch gear 50 when the latch gear 50 is rotated.

Operation of releasing the striker 10 will be described with reference to the accompanying drawings.

The release lever 70 shown in FIG. 10*a* is connected to the door handle by a link, a cable or the like, and receives external force.

Referring to FIG. 10*b*, when the door handle is operated, the release lever 70 is moved in the counterclockwise direction.

The release lever 70 is rotated in the counterclockwise direction from the completely locked location, as shown in FIG. 10*a*.

FIG. 10*b* shows the release lever 70 partially rotated in a releasing direction and the pawl 60 partially moved to a releasing location. FIG. 10*c* shows the release lever 70 completely rotated in the releasing direction and the pawl 60 completely moved to the releasing location. FIG. 10*d* shows the latch gear 50 rotated to the releasing location by elasticity of the second elastic member 120, and FIG. 10*e* shows the release lever 70 returned to a neutral location by elasticity of the first elastic member 110.

As described above the constraint force F1 transmitted to the pawl 60 through the latch gear 50 is distributed to the rotary portion 72 and the support shaft 90 adjoining the pawl 60, and thus, the latch gear 50 can be easily opened by a force weaker than the constraint force F1 transmitted to the pawl 60.

Next, a latch apparatus 1 according to another exemplary embodiment of the invention will be described with reference to the accompanying drawings.

For convenience of description, components having the same structures and functions as those of the above embodiment will be indicated by the same reference numerals, and detailed descriptions thereof will be omitted.

FIGS. 11*a* to 11*f* show a locking sequence of a latch apparatus according to another embodiment of the present invention, and FIGS. 12*a* to 12*e* show an opening sequence of a latch apparatus according to another embodiment of the present invention.

In this embodiment, the latch apparatus 1 includes a movable connecting member 130 connected to the release lever 70 and moving together with the release lever 70; and a coupling 140 having an operation space 142 in which the movable connecting member 130 is locked and moved, and moved by receiving operating force from a handle element 150.

Figure 11A:
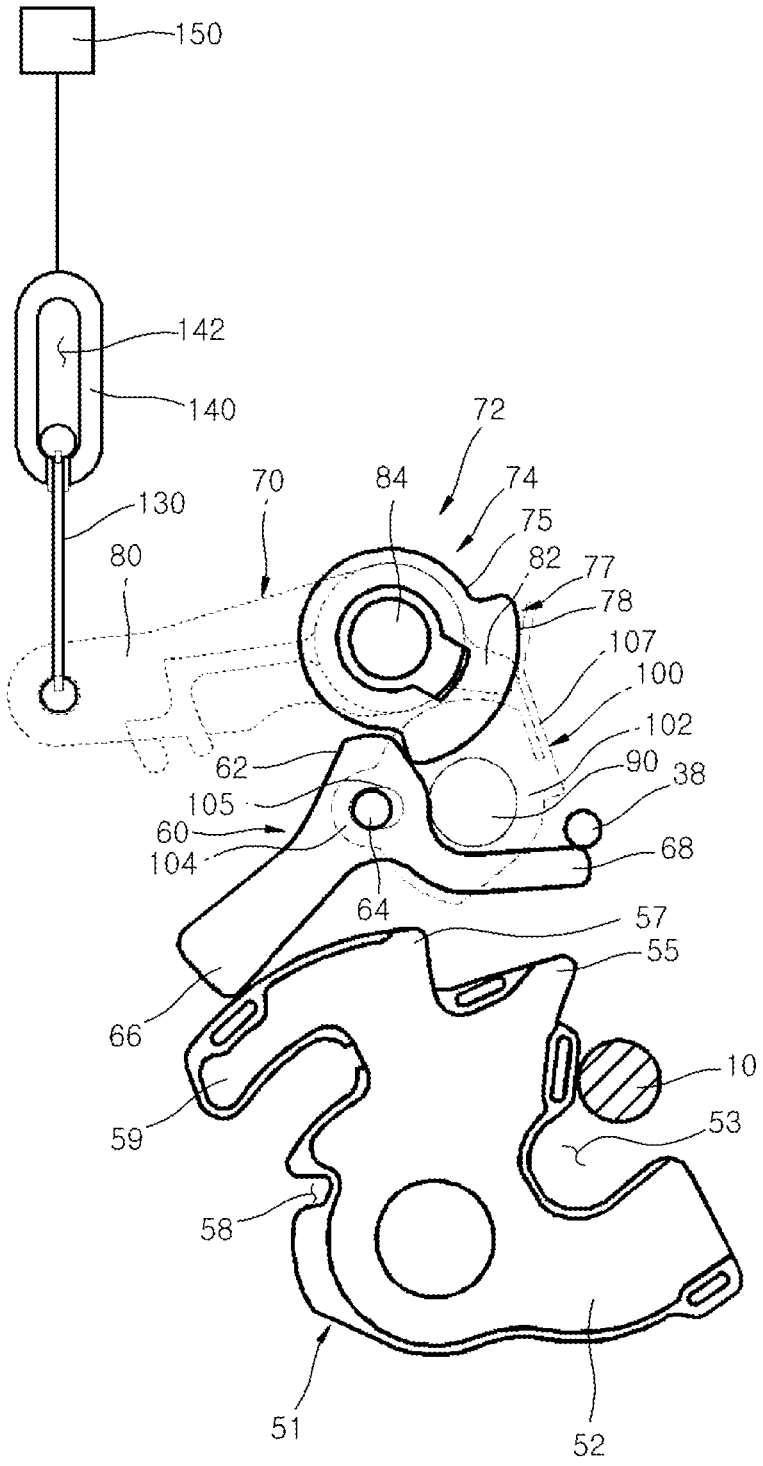
FIGS. 11*a* to 11*f* are views showing a locking sequence of a latch apparatus according to another embodiment of the present invention.

Referring to FIG. 11*a*, a latch gear 51 includes a tail 59 having a preset radius.

The coupling 140 having the operation space 142 is provided between the release lever 70 and the handle, and the other side of the movable connecting member 130 connected to the release lever 70 is movable along the operation space 142 of the coupling 140.

Figure 12A:
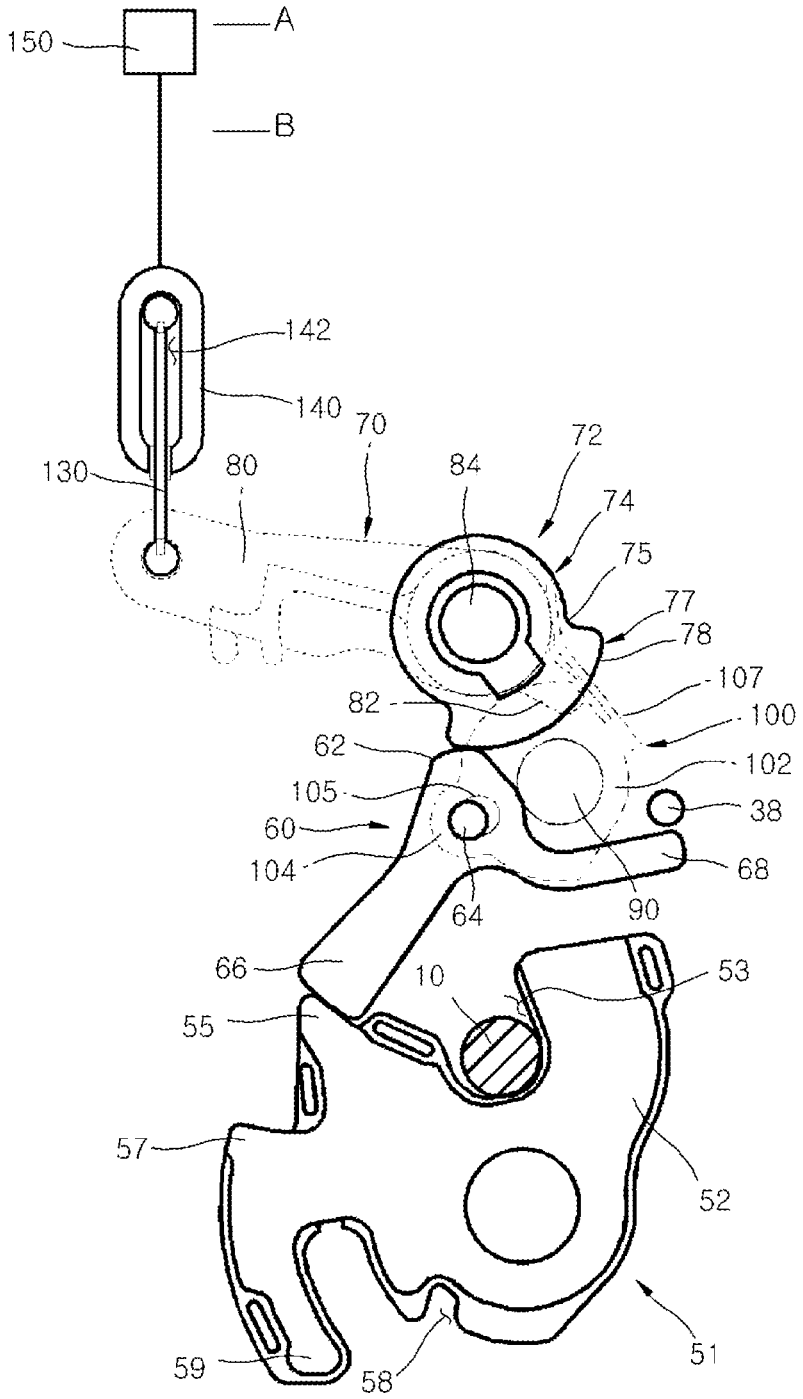
FIGS. 12*a* to 12*e* are views showing an opening sequence of a latch apparatus according to another embodiment of the present invention.

FIG. 12*a* shows the latch gear 51 at a second locking location corresponding to the completely locked state, and the handle element is at a stationary location.

Figure 12B:
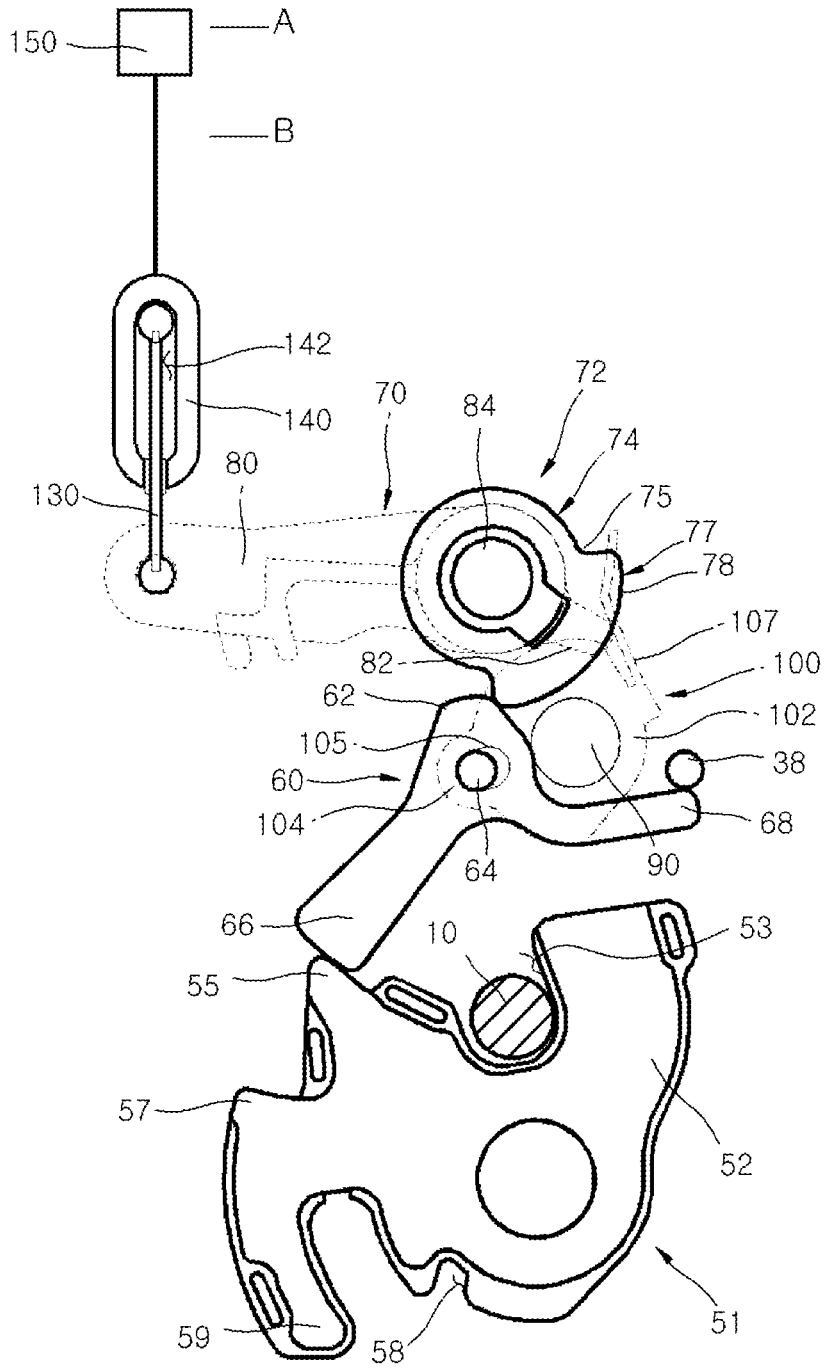
Figure 12C:
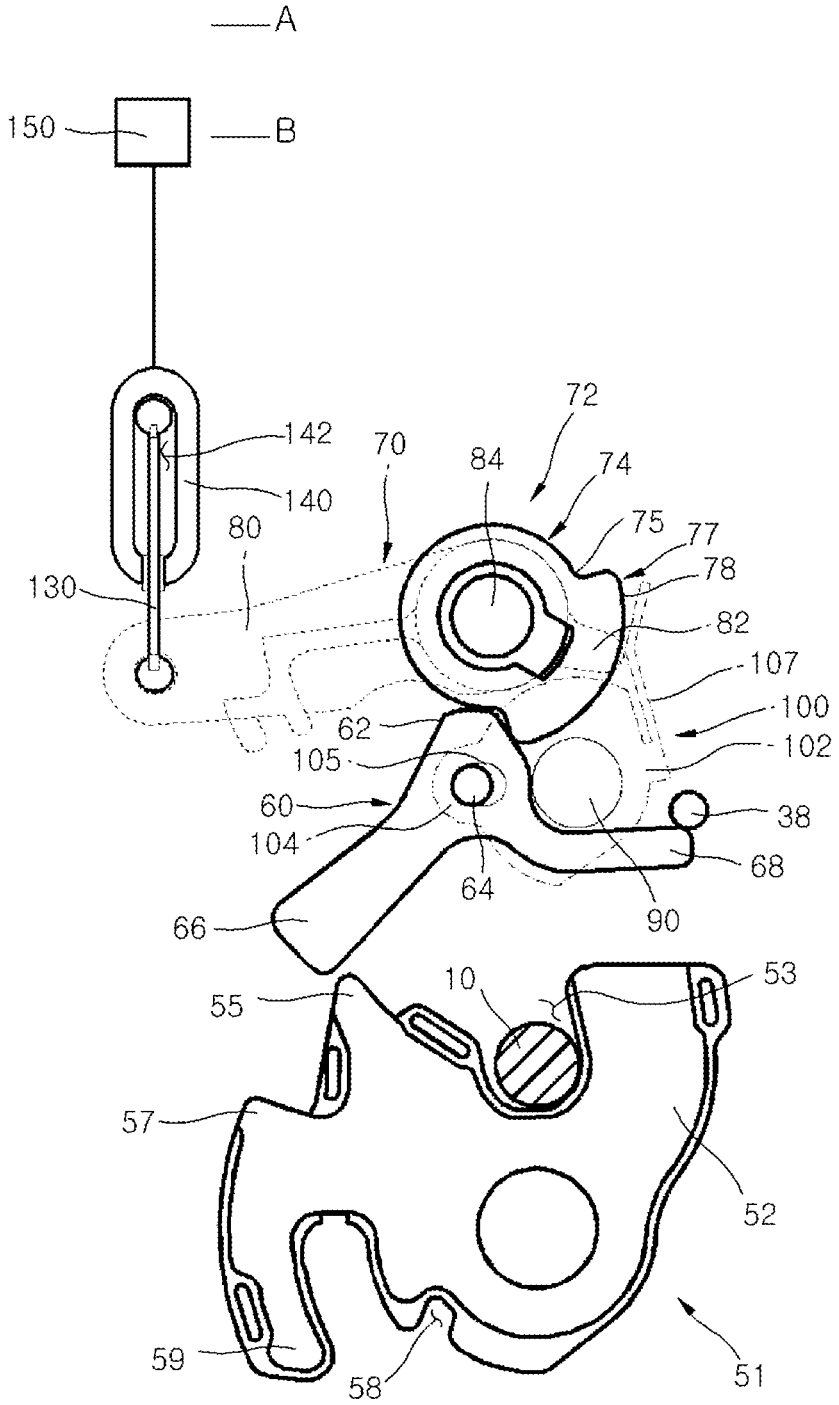
Figure 12D:
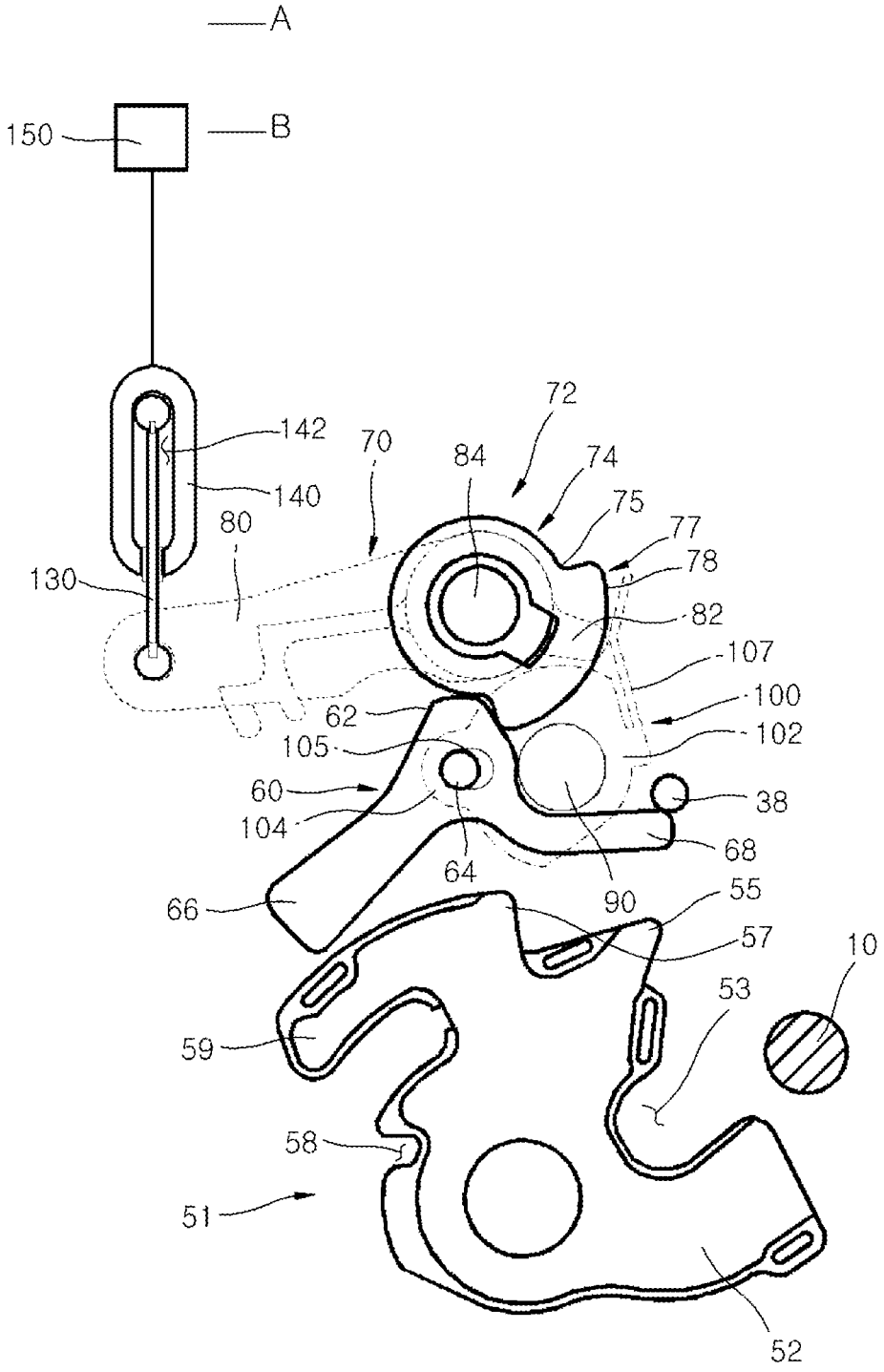

In FIG. 12*d*, the handle element 150 is moved down from location A to location B and is then returned to location B. As the handle element 150 is moved from the location A to the location B, the release lever 70 is rotated in the counterclockwise direction, whereby the striker 10 can be released from the latch gear 51.

As shown in FIG. 11*a*, even when the handle element 150 is returned to the location A, one end of the movable connecting member 130 moves toward a lower side of the operation space 142 provided to the coupling 140, whereby the release lever 70 can be maintained in a released state.

Although the release lever 70 is pressed in the clockwise direction by elasticity of the first elastic member 110, the release lever 70 is prevented from rotating by engaging with the pawl 60.

The latch gear 51 is moved to a release location in the clockwise direction, and the tail 59 of the latch gear 51 adjoins the locking protrusion 66 of the pawl 60, thereby preventing the pawl 60 from moving in the counterclockwise direction.

In addition, the pawl 60 adjoins the rotary portion 72 and thus prevents the rotary portion 72 from rotating in the clockwise direction. The rotary portion 72 is coupled to the lever body 80, and thus the lever body 80 and the rotary portion 72 are rotated together, thereby preventing the release lever 70 from rotating in the clockwise direction.

Transition from the second locking location corresponding to the completely locked state shown in FIG. 12*a* to the release location shown in FIG. 12*d* is achieved by operation of the handle element 150.

From the second locking location corresponding to the completely locked state shown in FIG. 12*a*, the handle element 150 of the door is moved down and moves the latch gear 51 in the release direction, as shown in FIGS. 12*b* and 12*c*.

Since the movable connecting member 130 is placed at an upper side of the operation space 142 of the coupling 140, downward movement of the handle element 150 causes the coupling 140 to move down and the movable connecting member 130 inside the coupling 140 is also moved down, thereby rotating the release lever 70 in the counterclockwise direction.

FIG. 12*b* illustrates that the handle element 150 is partially moved down in the direction of releasing the latch gear 51, and the release lever 70 and the pawl 60 are partially moved to the location of releasing the latch gear 51.

FIG. 12*c* illustrates that the handle element 150 is completely moved to the location of releasing the latch gear 51, and the release lever 70 and the pawl 60 are completely moved to the location of releasing the latch gear 51 in association with the handle element 150.

Figure 12E:
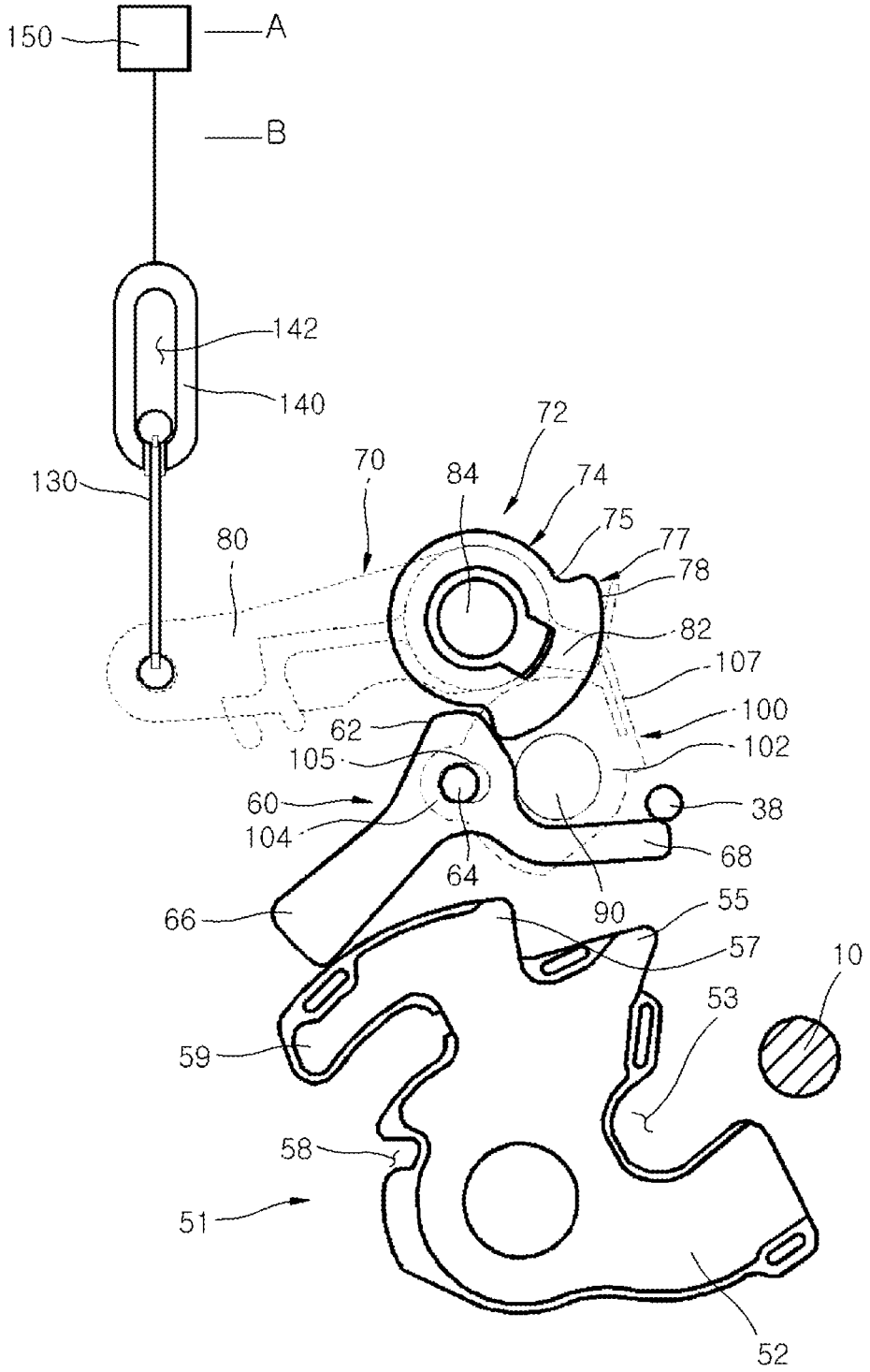

FIG. 12*d* illustrates the latch gear 51 rotated to the release location, and FIG. 12*e* illustrates that the release lever 70 is not rotated and only the handle element 150 is returned to an initial location while the locking protrusion 66 of the pawl 60 is in contact with the tail 59 of the latch gear 51.

The rotary portion 72 of the release lever 70, the lever body 80, the guide portion 100 and the pawl 60 shown in FIGS. 12*a* to 12*d* are operated in the same manner as those of the foregoing exemplary embodiment.

However, the release state of the latch gear 51 shown in FIG. 12*e* is different from the final release state of the latch gear 50 shown in FIG. 10*e* according to the foregoing exemplary embodiment.

That is, in FIG. 10*e*, the release lever 70, the rotary portion 72 and the pawl 60 are not prevented from moving in the release location of the latch gear 50 and are returned to the initial location as shown in FIG. 10*a*, since the latch gear 50 does not include the tail 59.

The rotary portion 72 of the release lever 70, the lever body 80 and the pawl 60 are reset to the location shown in FIG. 12*a* while the latch gear 51 is locked.

FIGS. 11*a* to 11*f* show the locking sequence of the latch gear 51. In the completely released location as shown in FIG. 11*a*, the handle element 150 is placed at the upper side.

Figure 11B:
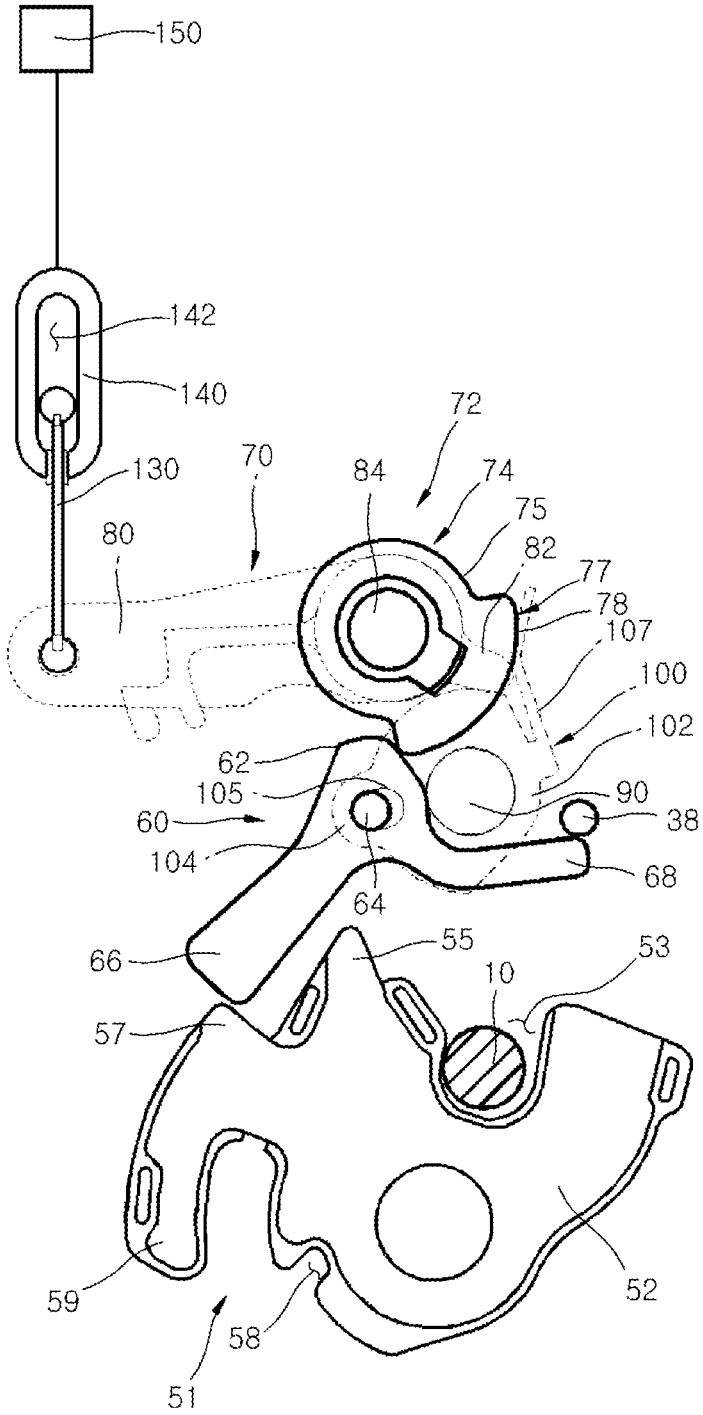
Figure 11C:
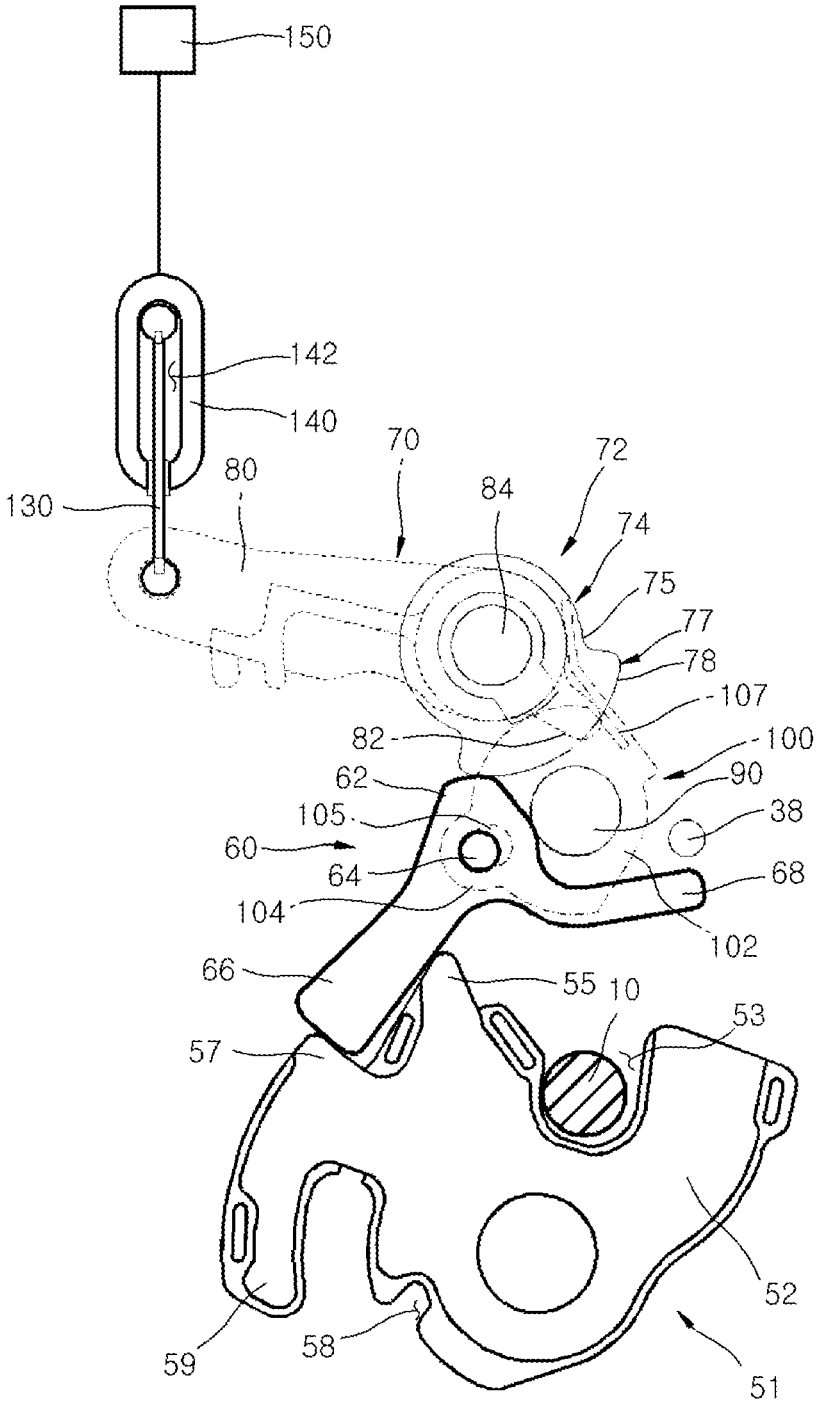
Figure 11D:
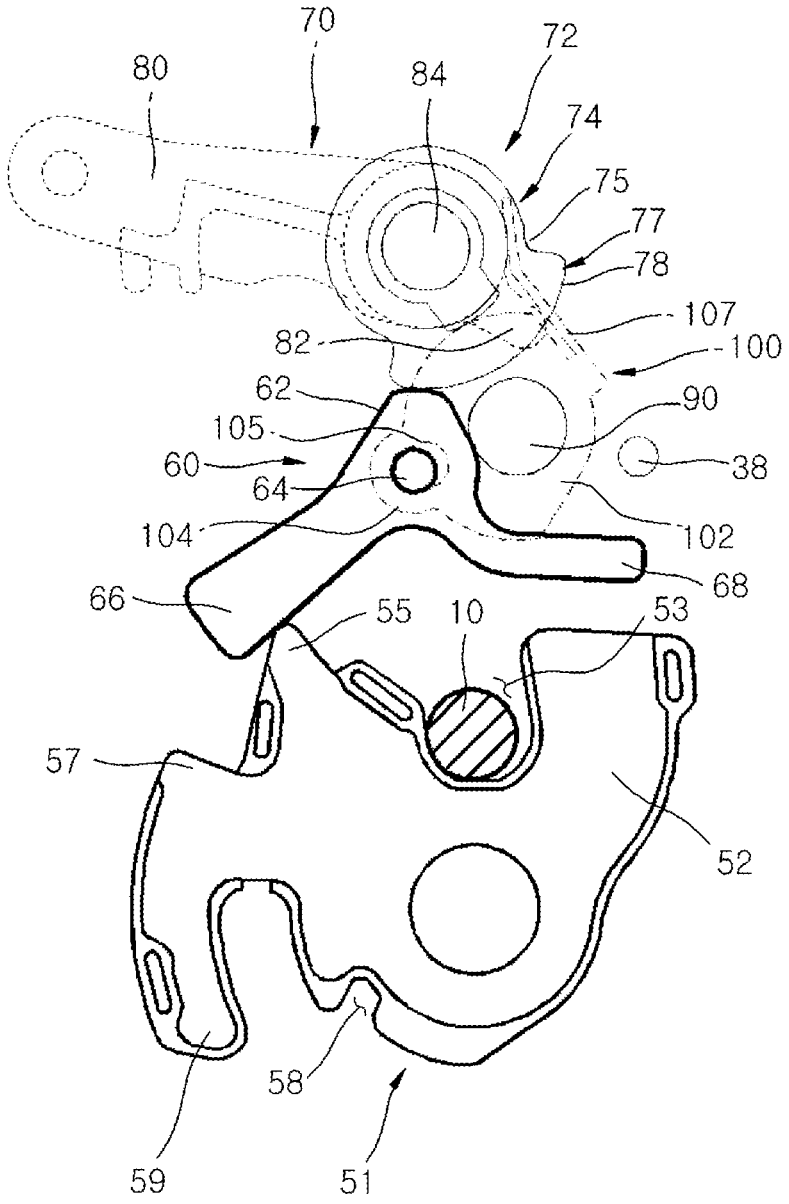
Figure 11E:
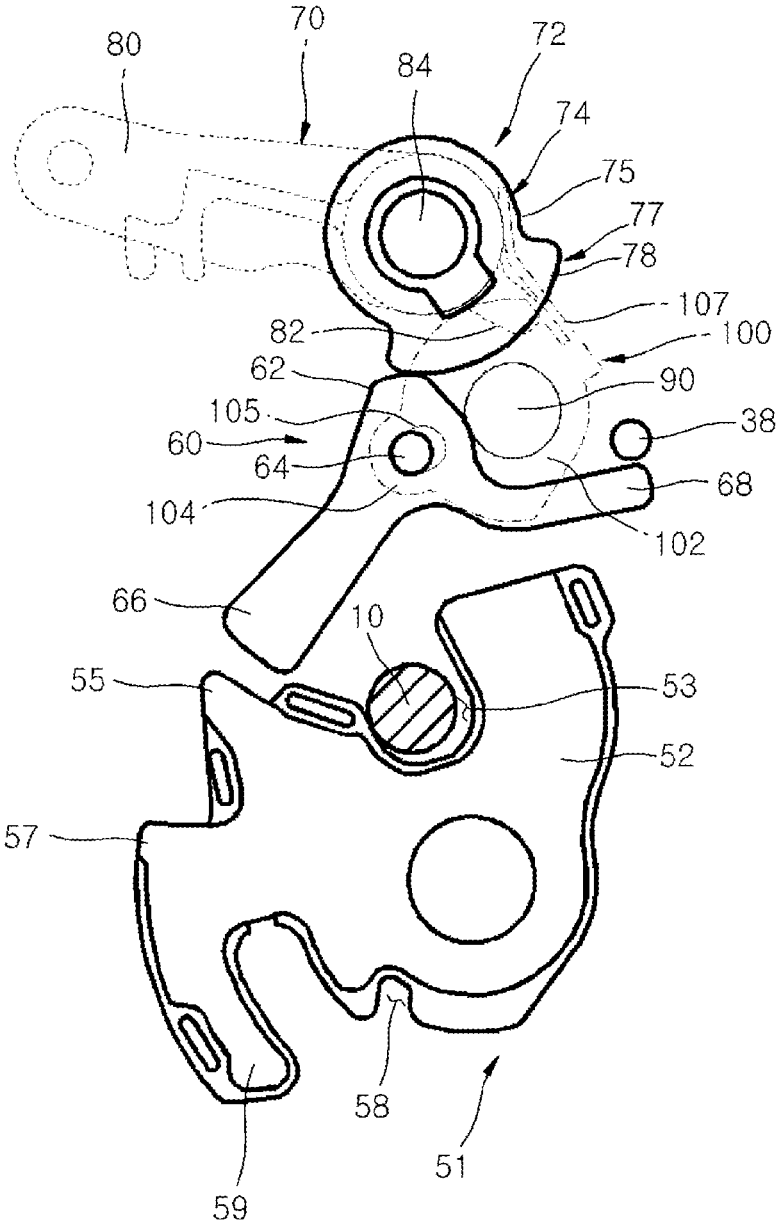
Figure 11F:
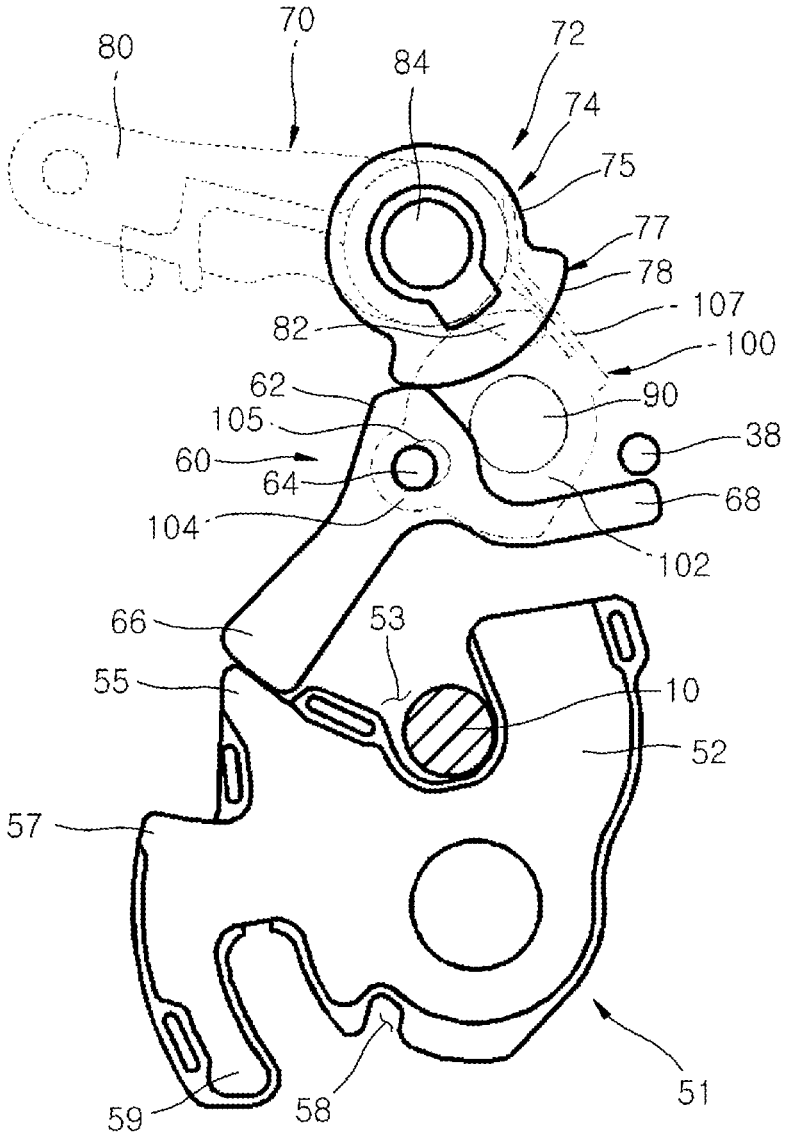

As shown in FIG. 11*b*, when the latch gear 51 reaches the first locking location corresponding to the safely locked state, the locking protrusion 66 of the pawl 60 is separated from the surface of the tail 59 of the latch gear 51.

The pawl 60 is not prevented from rotating in the counterclockwise direction, and also the rotary portion 72 and the lever body 80 are not prevented from rotating in the clockwise direction.

The lever body 80 and the rotary portion 72 of the release lever 70, and the pawl 60 are rotated to the initial location by elasticity of the first elastic member 110.

As such, in the latch apparatus according to the present invention, constraint force transmitted to the pawl through the latch gear is distributed to the rotary portion and the support shaft adjoining the pawl, whereby the latch gear can be easily opened even by a force weaker than the constraint force transmitted to the pawl.

Although some embodiments have been described herein, it should be understood by those skilled in the art that these embodiments are given by way of illustration only, and that various modifications, variations, and alterations can be made without departing from the spirit and scope of the invention. In addition, the latch apparatus disposed in a door for vehicles is just for illustrative purpose, and may be applied to other mechanisms for opening the door. Therefore, the scope of the invention should be limited only by the accompanying claims and equivalents thereof.

What is claimed is:

1. A latch apparatus comprising:

a base formed with an opening;

a latch gear formed with a mounting groove to lock a striker entering the mounting groove through the opening;

a pawl rotatably disposed on the base and engaging with the latch gear to prevent rotation of the latch gear;

a release lever disposed to adjoin the pawl, transmitting a constraint force for pressing the pawl, and rotating the pawl to release the latch gear;

a support shaft secured to the base, supporting a lateral surface of the pawl and transmitting the constraint force for pressing the pawl; and a guide portion rotatably provided to the support shaft, which is pressed to rotate by the release lever so as to guide movement of a projection pin provided to the pawl;

wherein the release lever comprises:

a rotary portion rotatably disposed on the base and pressing the pawl at different portions thereof when rotated;

a lever body coupled to the rotary portion to rotate together with the rotary portion so as to transmit an operating force manually or automatically; and a lever protrusion protruding from the lever body and pressing the guide portion, wherein the rotary portion comprises:

a rotary body into which the lever body is inserted and locked, and which externally forms a first curved surface; and a rotary protrusion protruding from an outer surface of the rotary body, adjoining the lateral surface of the pawl, and externally forming a second curved surface, wherein the guide portion comprises:

a guide body through which the support shaft passes;

a guide projection extending from the guide body and forming an inner space in which the projection pin moves; and a guide plate protruding from the guide body and elastically adjoining a lateral surface of the release lever.

2. The latch apparatus according to claim 1, wherein the latch gear comprises:

a latch body formed with the mounting groove and rotatably disposed on the base;

a first locking portion protruding from a lateral surface of the latch body and adjoining the pawl at a first locking location; and a second locking portion separated from the first locking portion, protruding from the lateral surface of the latch body, and adjoining the pawl at a second locking location.

3. The latch apparatus according to claim 1, wherein the inner space comprises an elongated hole.

4. The latch apparatus according to claim 1, further comprising:

a first elastic member supported at opposite sides thereof by the pawl and the release lever so as to press the pawl and the release lever to rotate in different directions.

5. The latch apparatus according to claim 1, further comprising:

a movable connecting member connected to the release lever and moving together with the release lever; and a coupling forming an operation space in which the movable connecting member is locked and moved, and moved by operating force received from a handle element.

* * * * *